US007838824B2

(12) United States Patent
Vestal

(10) Patent No.: US 7,838,824 B2
(45) Date of Patent: Nov. 23, 2010

(54) TOF-TOF WITH HIGH RESOLUTION PRECURSOR SELECTION AND MULTIPLEXED MS-MS

(75) Inventor: Marvin L. Vestal, Framinghan, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 677 days.

(21) Appl. No.: 11/742,709

(22) Filed: May 1, 2007

(65) Prior Publication Data

US 2008/0272291 A1 Nov. 6, 2008

(51) Int. Cl.
*H01J 49/40* (2006.01)

(52) U.S. Cl. ..... 250/287; 250/282; 250/288

(58) Field of Classification Search ..... 250/281, 250/282, 283, 286, 287, 288
See application file for complete search history.

(56) References Cited

U.S. PATENT DOCUMENTS

| | | | | |
|---|---|---|---|---|
| 4,730,111 | A | | 3/1988 | Vestal et al. |
| 4,731,533 | A | | 3/1988 | Vestal |
| 4,766,312 | A | | 8/1988 | Fergusson et al. |
| 4,814,612 | A | | 3/1989 | Vestal et al. |
| 4,861,989 | A | | 8/1989 | Vestal et al. |
| 4,883,958 | A | | 11/1989 | Vestal |
| 4,902,891 | A | | 2/1990 | Vestal |
| 4,958,529 | A | | 9/1990 | Vestal |
| 4,960,992 | A | | 10/1990 | Vestal et al. |
| 5,015,845 | A | | 5/1991 | Allen et al. |
| 5,160,840 | A | | 11/1992 | Vestal |
| 5,166,518 | A | * | 11/1992 | Freedman ..... 250/296 |
| 5,498,545 | A | | 3/1996 | Vestal |
| 5,625,184 | A | | 4/1997 | Vestal et al. |
| 5,627,369 | A | | 5/1997 | Vestal et al. |
| 5,760,393 | A | | 6/1998 | Vestal et al. |
| 6,002,127 | A | | 12/1999 | Vestal et al. |
| 6,057,543 | A | | 5/2000 | Vestal et al. |
| 6,175,112 | B1 | | 1/2001 | Karger et al. |
| 6,281,493 | B1 | | 8/2001 | Vestal et al. |
| RE37,485 | E | | 12/2001 | Vestal |
| 6,348,688 | B1 | | 2/2002 | Vestal |
| 6,414,306 | B1 | | 7/2002 | Mayer-Posner et al. |
| 6,441,369 | B1 | | 8/2002 | Vestal et al. |

(Continued)

FOREIGN PATENT DOCUMENTS

| | | |
|---|---|---|
| GB | 2 370 114 | 6/2002 |

OTHER PUBLICATIONS

R. Kaufmann, et al., "Sequencing of Peptides in a Time-of-Flight Mass Spectrometer-Evaluation of Postsource Decay . . . ," Int. J. Mass Spectrom. Ion Process. 131: 355-385 (1994).

(Continued)

*Primary Examiner*—Jack I Berman
*Assistant Examiner*—Nicole Ippolito Rausch
(74) *Attorney, Agent, or Firm*—Kurt Rauschenbach; Rauschenbach Patent Law Group, LLP

(57) ABSTRACT

The present invention comprises apparatus and methods for rapidly and accurately determining mass-to-charge ratios of molecular ions produced by a pulsed ionization source, and for fragmenting substantially all of the molecular ions produced while rapidly and accurately determining the intensities and mass-to-charge ratios of the fragments produced from each molecular ion.

12 Claims, 13 Drawing Sheets

U.S. PATENT DOCUMENTS

| | | | | |
|---|---|---|---|---|
| 6,504,150 | B1 | 1/2003 | Verentchikov et al. | |
| 6,512,225 | B2 | 1/2003 | Vestal et al. | |
| 6,534,764 | B1 | 3/2003 | Verentchikov et al. | |
| 6,541,765 | B1 | 4/2003 | Vestal | |
| 6,621,074 | B1 * | 9/2003 | Vestal | 250/287 |
| 6,670,609 | B2 | 12/2003 | Franzen et al. | |
| 6,674,070 | B2 | 1/2004 | Karger et al. | |
| 6,770,870 | B2 | 8/2004 | Vestal | |
| 6,825,463 | B2 | 11/2004 | Karger et al. | |
| 6,831,270 | B2 | 12/2004 | Furuta et al. | |
| 6,844,545 | B1 | 1/2005 | Hutchins et al. | |
| 6,900,061 | B2 | 5/2005 | Smirnov et al. | |
| 6,918,309 | B2 | 7/2005 | Brock et al. | |
| 6,933,497 | B2 | 8/2005 | Vestal | |
| 6,952,011 | B2 | 10/2005 | Brown et al. | |
| 6,953,928 | B2 | 10/2005 | Vestal et al. | |
| 6,995,363 | B2 | 2/2006 | Donegan et al. | |
| 7,030,373 | B2 | 4/2006 | Vestal et al. | |
| 7,064,319 | B2 | 6/2006 | Hashimoto et al. | |
| 7,109,480 | B2 | 9/2006 | Vestal et al. | |
| RE39,353 | E | 10/2006 | Vestal | |
| 7,176,454 | B2 | 2/2007 | Hayden et al. | |
| 7,265,346 | B2 * | 9/2007 | Whitehouse et al. | 250/287 |
| 2002/0092980 | A1 * | 7/2002 | Park | 250/288 |
| 2002/0158194 | A1 * | 10/2002 | Vestal et al. | 250/287 |
| 2003/0057368 | A1 | 3/2003 | Franzen et al. | |
| 2003/0116707 | A1 | 6/2003 | Brown et al. | |
| 2003/0141447 | A1 | 7/2003 | Verentchikov et al. | |
| 2004/0108452 | A1 * | 6/2004 | Graber et al. | 250/281 |
| 2004/0113064 | A1 * | 6/2004 | Fuhrer et al. | 250/287 |
| 2005/0031496 | A1 | 2/2005 | Laurell et al. | |
| 2005/0087685 | A1 | 4/2005 | Bouvier et al. | |
| 2005/0116158 | A1 * | 6/2005 | Krutchinsky et al. | 250/281 |
| 2005/0130222 | A1 | 6/2005 | Lee | |
| 2005/0173627 | A1 * | 8/2005 | Cotter et al. | 250/288 |
| 2005/0178959 | A1 | 8/2005 | Lopez-Avila et al. | |
| 2005/0279933 | A1 | 12/2005 | Appelhans et al. | |
| 2006/0266941 | A1 | 11/2006 | Vestal | |
| 2006/0273252 | A1 | 12/2006 | Hayden et al. | |
| 2007/0029473 | A1 * | 2/2007 | Verentchikov | 250/281 |
| 2007/0038387 | A1 | 2/2007 | Chen et al. | |
| 2007/0054416 | A1 | 3/2007 | Regnier et al. | |
| 2008/0067349 | A1 * | 3/2008 | Moskovets et al. | 250/287 |

OTHER PUBLICATIONS

J. Preisler, et al., "Capillary Array Electrophoresis-Maldi Mass Spectrometry using a Vacuum Deposition Interface," Anal. Chem. 74: 17-25 (2002).

R. L. Caldwell and R. M. Caprioli, "Tissue Profiling by Mass Spectrometry," MCP 4: 394-401 (2005).

M. L. Vestal, et al., "Delayed Extraction Matrix-Assisted Laser Desorption Time-ofFlight Mass Spectrometry," Rapid Comm. Mass Spectrom. 9: 1044-1050 (1995).

M. L. Vestal and P. Juhasz, "Resolution and Mass Accuracy in Matrix-Assisted Laser Desorption Time-of-Flight Mass Spectrometry," J. Am. Soc. Mass Spectrom. 9: 892-911 (1998).

E. J. Takach, et al., "Accurate Mass Measurement using MALDI-TOF with Delayed Extraction," J. Prot. Chem. 16: 363-369 (1997).

D. J. Beussman, et al., "Tandem Reflectron Time-of-Flight Mass Spectrometer Utilizing Photodissociation," Anal. Chem. 67: 3952-3957 (1995).

M. L. Vestal, "High-Performance Liquid Chromatography-Mass Spectrometry," Science 226: 275-281 (1984).

"Notification Of Transmittal Of The International Search Report And The Written Opinion Of The International Searching Authority, Or The Declaration" For PCT/US2010/022122, Aug. 16, 2010, 9 pages, International Searching Authority, Korean Intellectual Property Office, Seo-gu, Daejeon, Republic of Korea.

* cited by examiner

TOF-TOF WITH HIGH RESOLUTION PRECURSOR SELECTION AND MULTIPLEXED MS-MS

BACKGROUND OF THE INVENTION

Many applications require accurate determination of the molecular masses and relative intensities of metabolites, peptides and intact proteins in complex mixtures. Time-of-flight (TOF) with reflecting analyzers provides excellent resolving power, mass accuracy, and sensitivity at lower masses (up to 5-10 kda), but performance is poor at higher masses primarily because of substantial fragmentation of ions in flight. At higher masses, simple linear TOF analyzers provide satisfactory sensitivity, but resolving power and mass accuracy are low. A TOF mass analyzer combining the best features of reflecting and linear analyzers is required for these applications.

An important advantage of TOF mass spectrometry (MS) is that essentially all of the ions produced are detected, unlike scanning MS instruments. This advantage is lost in conventional MS-MS instruments where each precursor is selected sequentially and all non-selected ions are lost. This limitation can be overcome by selecting multiple precursors following each laser shot and recording fragment spectra from each can partially overcome this loss and dramatically improve speed and sample utilization without requiring the acquisition of raw spectra at a higher rate.

All of these improvements will have limited impact unless the instruments are reliable, cost-effective, and very easy to use. Improvements in instrumentation which affect each of these issues are found in the present invention.

Several approaches to matrix assisted laser desorption/ionization (MALDI)-TOF MS-MS are described in the prior art. All of these are based on the observation that at least a portion of the ions produced in the MALDI ion source may fragment as they travel through a field-free region. Ions may be energized and caused to fragment as the result of excess energy acquired during the initial laser desorption process, or by energetic collisions with neutral molecules in the plume produced by the laser, or by collisions with neutral gas molecules in the field-free drift region. These fragment ions travel through the drift region with approximately the same velocity as the precursor, but their kinetic energy is reduced in proportion to the mass of the neutral fragment that is lost. A timed-ion-selector may be placed in the drift space to transmits a small range of selected ions and reject all others. In a TOF analyzer employing a reflector, the lower energy fragment ions penetrate less deeply into the reflector and arrive at the detector earlier in time than the corresponding precursors. Conventional reflectors focus ions in time over a relatively narrow range of kinetic energies; thus only a small mass range of fragments are focused for given potentials applied to the reflector.

In the pioneering work by Spengler and Kaufmann this limitation was overcome by taking a series of spectra at different mirror voltages and piecing them together to produce the complete fragment spectrum. An alternate approach is to use a "curved field reflector" that focuses the ions in time over a broader energy range. The TOF-TOF approach employs a pulsed accelerator to re-accelerate a selected range of precursor ions and their fragments so that the energy spread of the fragments is sufficiently small that the complete spectrum can be adequately focused using a single set of reflector potentials. All of these approaches have been used to successfully produce MS-MS spectra following MALDI ionization, but each suffers from serious limitations that have stalled widespread acceptance. For example, each involves relatively low-resolution selection of a single precursor, and generation of the MS-MS spectrum for that precursor, while ions generated from other precursors present in the sample are discarded. Furthermore, the sensitivity, speed, resolution, and mass accuracy for the first two techniques are inadequate for many applications.

SUMMARY OF THE INVENTION

The present invention comprises apparatus and methods for rapidly and accurately determining mass-to-charge ratios of molecular ions produced by a pulsed ionization source, and for fragmenting substantially all of the molecular ions produced while rapidly and accurately determining the intensities and mass-to-charge ratios of the fragments produced from each molecular ion. The mass spectrometer analyzer according to the invention comprises a MALDI sample plate and pulsed ion source located in an evacuated ion source housing; an analyzer vacuum housing isolated from the ion source vacuum housing by a gate valve containing an aperture and maintained at ground potential; a vacuum generator that maintains high vacuum in the analyzer; a pulsed laser beam that enters the ion source housing through the aperture in the gate valve when the valve is open and strikes the surface of a sample plate within the source producing ions that enter the analyzer through the aperture; a symmetrical arrangement of four two-stage ion mirrors in close proximity to the gate valve; a field-free drift space at ground potential; a timed-ion-selector and an ion detector, both at nominally the same distance from the exit from the ion mirrors; high voltage supplies for supplying electrical potentials to the ion mirrors; ion deflectors or deflection electrodes in close proximity to the exit of the mirrors energized to deflect ions either to the detector or the timed-ion selector; a second pulsed ion accelerator aligned with the timed-ion-selector; a second field-free region biased at a predetermined potential; a two-stage gridded mirror reflecting ions passing through the second field-free region; and a detector positioned to receive reflected ions.

In one embodiment the pulsed ion source is a matrix assisted laser desorption/ionization (MALDI) source employing delayed extraction.

In one embodiment the MALDI source employs a laser operating at 5 khz.

In one embodiment the electrical field adjacent to the sample plate in the MALDI source is approximately equal to the maximum value that can be sustained without initiating an electrical discharge. In one embodiment this electrical field is approximately 30 kV/cm.

The instrument of the present invention provides both MS and MS-MS for identification of peptides and other molecules. This instrument is unique in that it provides high-resolution precursor selection with MALDI MS-MS. Single isotopes can be selected and fragmented up to m/z 4000 with no detectable loss in ion transmission and less than 1% contribution from adjacent masses. This instrument also allows up to 50 fold multiplexing in MS-MS. Selected masses must differ by at least 1.2%, and are preferably within an order of magnitude range in intensity. This allows the generation of very high quality MS-MS spectrum at unprecedented speed. Use of the analyzer of the present invention allows all of the peptides present in a complex peptide mass fingerprint, containing a hundred or more peaks, to be fragmented and identified without exhausting the sample. This allows speed and sensitivity of the MS-MS measurements to keep pace with the MS results. The combination of high-resolution precursor selection with high laser rate and multiplexing allows high-quality, interpretable MS-MS spectra to be generated on detected peptides at the 10 attomole/uL level.

In earlier TOF-TOF designs, operation in MS-MS mode involves acceleration of ions from a source at about 8 kV, selecting precursor ions with a timed-ion-selector at ground potential, followed by deceleration of the ions to the final collision energy of 1-2 kV. This arrangement was dictated by the need for the ion source and other elements to perform adequately in both linear and reflector MS mode.

In the present invention the goal was to provide the best performance consistent with high reliability for single-mode operation. To this end, optimal results are obtained when operating the pulsed ion source at the final collision energy and operating with the sample plate (before applying the pulse), the timed-ion-selector, the collision cell, and the second source all at ground potential. Concurrently, the drift space after the second source and the detector are operated at elevated potential to further accelerate the fragments.

The present invention provides a tandem time-of-flight mass spectrometer comprising a pulsed ion source located in an evacuated ion source housing, said housing configured to receive a MALDI sample plate; a tandem time-of-flight analyzer located in an analyzer vacuum housing; and a gate valve at ground potential located between and operably connecting said evacuated ion source housing and said analyzer vacuum housing.

In one embodiment, the analyzer comprises a symmetrical array of four two-stage ion mirrors configured to receive ions from the pulsed ion source and to transmit ions along an exit trajectory through the mirrors substantially coincident with an entrance trajectory of the mirrors independent of the kinetic energy of the ions; a first field-free region at ground potential; a first timed-ion-selector located in the first field-free region and positioned at a focal point of the symmetrical mirror array; a first ion detector located in the first field-free region and positioned at a focal point of the symmetrical mirror array and displaced latterly from said first timed-ion-selector; an ion deflector energized to direct ions to either the first timed-ion-selector or the first ion detector; a pulsed ion accelerator aligned to receive selected ions from the first timed-ion selector; a second field-free region biased at a predetermined voltage relative to ground potential to receive ions from the pulsed ion accelerator; a two-stage ion mirror located at the end of said second field-free region opposite said pulsed ion accelerator; and a second ion detector positioned at a focal point of said two-stage gridded mirror and having an input surface in electrical contact with said second field-free region.

In a preferred embodiment the second timed-ion-selector is positioned within the second field-free region at a predetermined distance from the pulsed ion accelerator.

In one embodiment the spectrometer includes a collision cell aligned to receive ions selected by the first timed-ion selector, to cause the selected ions to fragment, and to direct the transmission of said selected ions and their associated fragments to the pulsed ion accelerator.

In one embodiment the tandem time-of-flight mass spectrometer of the invention, the pulsed ion source comprises a pulsed laser beam directed to strike the MALDI sample plate and produce a pulse of ions; a high voltage pulse generator; and a time delay generator providing a predetermined time delay between the laser beam pulse and the high voltage pulse.

In a preferred embodiment, the spectrometer's predetermined time delay comprises and uncertainty which is not more than 1 nanosecond.

In one embodiment, the pulsed ion source contains one or more ion optical elements for directing and/or spatially focusing the ion beam. The optical elements comprise an extraction electrode at ground potential in close proximity to the MALDI sample plate; an ion lens located between the extraction electrode and the gate valve; and one or more pairs of deflection electrodes located between the ion lens and the gate valve with any pair energized to deflect ions in either of two orthogonal directions.

In the present invention, one or more of the deflection electrodes of any pair is energized by a time-dependent voltage resulting in the deflection of ions in one or more selected mass ranges.

In one embodiment, the distance between the MALDI sample plate and the extraction electrode is between 0.1 and 3 mm.

In one embodiment, the distance between the MALDI sample plate and the extraction electrode is between 0.5 and 2 mm.

In one embodiment, the distance between the MALDI sample plate and the extraction electrode is 1 mm.

In a preferred embodiment of the present invention, the distance between the MALDI sample plate and the extraction electrode is 1 mm and the amplitude of the pulse produced by the high-voltage pulse generator is 2 kV.

In one embodiment, the gate valve when open comprises an aperture through which the pulsed laser beam passes from the analyzer vacuum housing to the evacuated ion source housing and the pulsed ion beam passes from the evacuated ion source housing to the analyzer vacuum housing.

According to the present invention, each of the two-stage ion mirrors comprises two substantially uniform fields having field boundaries defined by grids that are substantially parallel.

In another embodiment, each of the two-stage ion mirrors comprises two substantially uniform fields having field boundaries defined by substantially parallel conducting diaphragms with small apertures aligned with the incident and reflected ion beams.

In one embodiment, the electrical field strength in the first stage of each of the two-stage ion mirrors, said first stage being characterized as that stage adjacent to the field-free region, is substantially greater than the electrical field strength in the second stage of the two-stage ion mirrors.

In another embodiment, the electrical field strength in the first stage of each of the two-stage ion mirrors, said first stage being characterized as that stage adjacent to the field-free region is at least two but not greater than 4 times the electrical field strength in the second stage of the two-stage ion mirrors.

According to the present invention, the second ion detector may comprise a dual channel plate assembly with an input surface in electrical contact with the second field-free region and an anode at ground potential. In this embodiment the potential difference across the channel plate assembly is provided by a voltage divider between the potential applied to the second field-free region and ground. In another embodiment, the potential difference across the channel plate assembly is adjusted by changing the resistance of the portion of the voltage divider near a grounded terminal of said voltage divider.

In one embodiment of the invention, the first timed-ion-selector employs an alternating wire deflector with time dependent voltages of opposite polarity connected to adjacent wires wherein the voltages switch polarity at the time that a selected ion reaches the gate.

In one embodiment, the pulsed laser beam of the tandem time-of-flight mass spectrometer operates at a frequency of 5 khz.

In one embodiment the physical length of the pulsed ion accelerator is less than 1% of the effective distance from the pulsed ion source to the pulsed ion accelerator.

The present invention also provides a method for multiplex operation of a tandem time-of-flight mass spectrometry comprising the steps of using a first timed-ion-selector to select a predetermined set of ions following each laser pulse, said set of ions comprising one or more precursor ions and their associated fragments, accelerating said predetermined set of ions using a pulsed ion accelerator, detecting said predetermined set of ions using a second ion detector. In this method a portion of the fragment spectrum from each precursor is selected by a second timed-ion-selector and transmitted to said second ion detector with the remaining portion of the fragment spectrum being deflected away from said second ion detector. Accordingly, in one embodiment the masses of any two precursors of the predetermined set of ions may differ by at least 1 percent. In another embodiment the masses of any two precursors of the predetermined set of ions may differ by at least 2 percent.

In another embodiment, fragment ions from precursor masses differing by a factor of 1.6 or less are assigned to the correct precursor by consideration of apparent mass defect of the fragment ion or by consideration of the intensity of the fragment ion relative to the intensity of the precursor.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
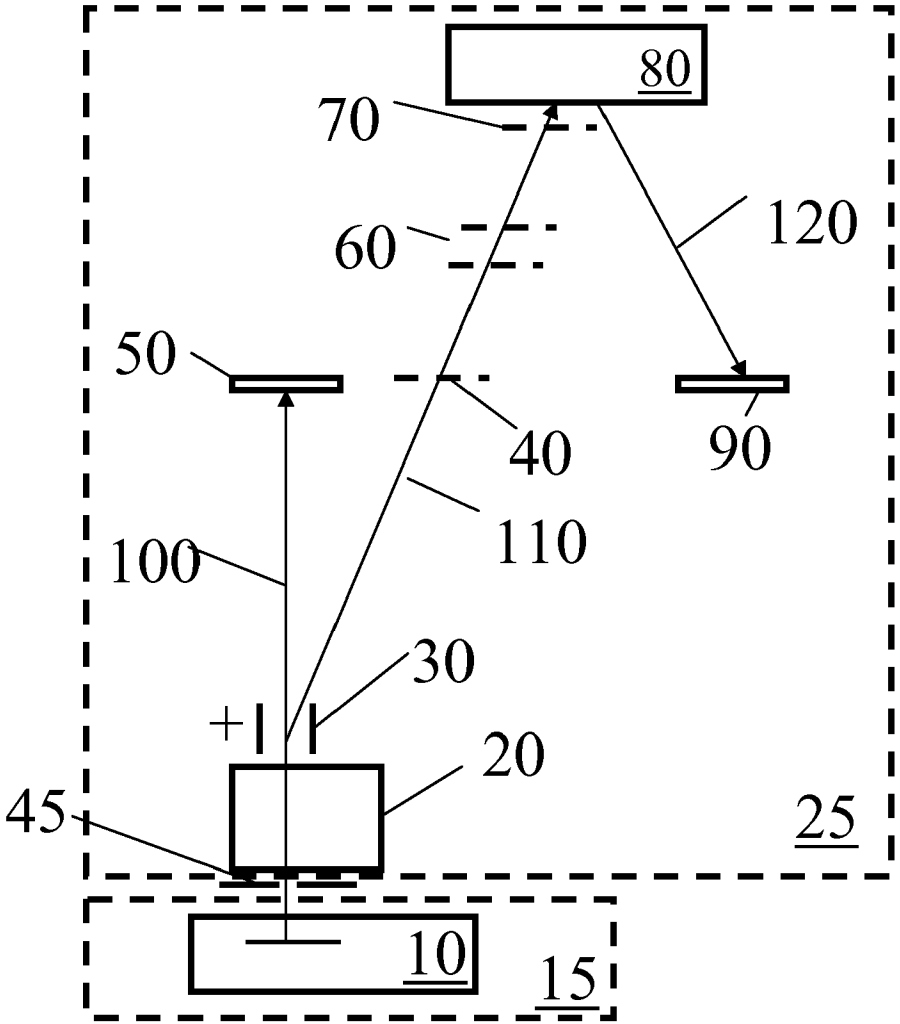
FIG. 1 is a schematic diagram of one embodiment of the MALDI-TOF-TOF mass analyzer of the present invention.

The ultimate performance of any TOF analyzer is proportional to the overall length of the flight path. Bigger is always better, at least in relation to resolving power. On the other hand, cost and convenience generally dictates a smaller size.

One embodiment of the present invention is based on using the approximate maximum size that can be readily be accommodated in a benchtop instrument. This is taken as 1500 mm in overall length. The other dimensions are chosen to obtain the required performance. Methods for estimating the performance of TOF systems have been described earlier.

Improving the Resolving Power of Precursor Selection by 10 Fold (4000 from 400)

The prior art TOF-TOF analyzers employ a relatively short (ca. 400-600 mm) linear first stage. Relatively high resolving power can be demonstrated for precursor selection at threshold laser intensity, but at the laser intensities required for sensitive MS-MS the maximum resolving power is about 400. This is limited by the increased spatial and velocity spread of the ion beam at high laser intensities, and cannot be improved significantly by increasing the flight distance or increasing the speed of the timed-ion-selector. The obvious way to deal with this problem is to use an analyzer including an ion reflector, and such systems have been described.

The difficulty with a conventional reflector is that it introduces energy-dependent dispersion, and as a result it is difficult to focus the beam into the second TOF analyzer.

One alternative is to employ a timed-ion-selector for precursor selection employing a Bradbury-Nielson alternating wire deflector using voltages that switch polarity at the time that the selected ion reaches the gate. This gate provides high resolving power for selecting a single isotope, but is not practical for selecting a region of mass such as an isotopic cluster.

Performance of MS-2

The design for the tandem time-of-flight analyzer (TOF-TOF analyzer system) according to this invention is chosen not only for achieving high performance for MS-1, but also for high performance for MS-2, both with single precursor selection and for multiplex operation with multiple precursors selected for each laser shot. The parameters chosen for achieving high performance in MS-1 also affect the performance of MS-2. For example, choosing a long effective distance for MS-1 improves the precursor resolving power, but it also increases the distance between adjacent mass peaks at the second source. In prior art TOF-TOF systems the precursor resolving power was insufficient to isolate individual isotope peaks; rather the entire isotopic envelope was chosen.

This has a profound effect on the resolving power of MS-2, particularly for lower mass fragments where the $^{12}C$ peaks have significant contributions from precursors containing one or more $^{13}C$ isotopes. To focus these fragment ions it is necessary to make the length of the second source large compared to the distance between adjacent masses as they arrive at the second source. Selection of monoisotopic peaks removes this problem and makes it possible to obtain higher resolving power, better mass accuracy, and better peak shapes in MS-2. This also allows the use of a much shorter second source, thus increasing the degree of multiplexing and improving the resolving power across the fragment spectrum. The resolving power is primarily limited by time resolution, and resolving powers of 4000 at fragment mass 100 and greater than 10,000 at the precursor mass are possible even with relatively low accelerating voltage on the second source. These improvements not only improve the quality of the fragment data for database searching, but also substantially reduce the difficulty of deconvoluting spectra in multiplex mode.

Multiplex MS-MS

In multiplex operation the precursor gate is opened every time a mass of interest reaches that point, and the second source acceleration is pulsed when that mass reaches the nominal position in the second source. An additional gate is provided after the second acceleration to allow transmission of only a selected portion of each fragment spectrum. A three-channel digital time delay generator provides up to 50 trigger pulses from each channel following each laser pulse to drive the gates and accelerator. These pulses are programmed according to the calculated flight times for the selected masses, and these times must be within 1 nanosecond of the calculated times.

The maximum degree of multiplexing is determined by the ratio of the minimum distance between selected ions at the second source accelerator, and the effective distance from the first source to the second. This minimum distance depends on the length of the second source, and the length of the fringing field near the entrance to the second source advantage of multiplexing is that the fragment mass scale of all of the peptides present can be internally calibrated using the fragments from a single known peptide. Thus, by adding an internal standard or using an identified peptide in the mix, the fragment spectra can be calibrated with an estimated uncertainty of about 10 ppm.

Higher resolution precursor selection will also improve the reliability of deconvolution by removal of isotope peaks. Searching against a database of measured spectra rather than theoretical spectra with no intensity information should also dramatically improve the speed and reliability of deconvolution. Multiplexing is most useful in cases requiring highest throughput, but where most of the expected proteins have been detected and analyzed in previous measurements.

The deconvolution problem may be solved by considering a relatively wide window, approximately 0.4 da, that includes essentially all possible exact masses of peptides at a given nominal mass, then for a peptide with m/z 2000 there are 5000 time bins that could potentially contain fragments. For a typical fragment spectrum that includes at most 50 peaks with significant intensity, only 50 of these bins are occupied. Thus for any 2 precursors the probability that peaks from each are detected in a single bin is not more than 0.01%. On the other hand, there is about a 40% chance that a peak from one occurs at a possible peptide mass in the region of overlap. Thus, the time region corresponding to possible fragments from a given precursor might contain 20 peaks due to overlapping spectra in addition to the 50 correct peaks. This may lead to some false identifications in the first pass, but with 10 ppm accuracy for the fragment masses, most of these can be eliminated in a second pass. With 10 ppm accuracy the probability of incorrect assignment of a peak is reduced to about 1%.

One embodiment of the invention is illustrated in FIG. 1. A pulse of ions is produced in MALDI pulsed ion source 10 located in an evacuated ion source housing 15. Ions are accelerated and directed through a gate valve 45 into analyzer vacuum housing 25. It will be understood that while the evacuated ion source housing 15 and the analyzer vacuum housing 25 are separately labeled, they are in fact operably connected via the gate valve 45 with the sides of the two housings being functionally coincident. Ions pass through in-line energy corrector 20 and are focused such that the flight time of ions of a predetermined mass to a first ion detector 50 along a first ion path 100 is independent of kinetic energy to first and second order. This generates a time-of-flight spectrum that allows the mass-to-charge ratio of the ions to be determined. Alternatively, an energizing deflector 30 may be energized to direct ions along a second ion path 110 to a first timed-ion-selector 40. The first timed-ion-selector may be energized to transmit only ions with predetermined m/z values and to reject all others by, for example, deflecting the rejected ions in a direction perpendicular to the plane of the figure.

Selected ions continue along the second ion path 110 to a pulsed ion accelerator 60 where selected ions are accelerated by a voltage pulse applied at the time a selected ion arrives at the accelerator. Fragment ions formed along the second ion path 110 continue to travel with substantially the same velocity as their precursor. Thus a selected precursor and its fragments are transmitted by the first timed-ion-selector 40 and the precursor and fragments are accelerated by the pulse applied to pulsed ion accelerator 60. After acceleration, the fragments and their precursor have different velocities and are dispersed by a two-stage gridded ion mirror 80 and by traveling along a third ion path 120 to a second ion detector 90. Thus a selected precursor ion and its fragments arrive at the detector at different times, and these flight times are converted to a fragment mass spectrum for each precursor mass forming an MS-MS spectrum. A second timed-ion-selector 70 may be energized to allow only a portion of each fragment spectrum to be transmitted to the detector. For example, the second timed-ion-selector 70 may be energized to remove residual precursor ions and any fragment ions formed along the third ion path 120 between the accelerator and the detector. Alternatively, the second timed-ion selector 70 may be energized to transmit only a predetermined portion of a fragment spectrum to minimize overlap between fragment spectra from different precursors in multiplexed mode.

Figure 2:
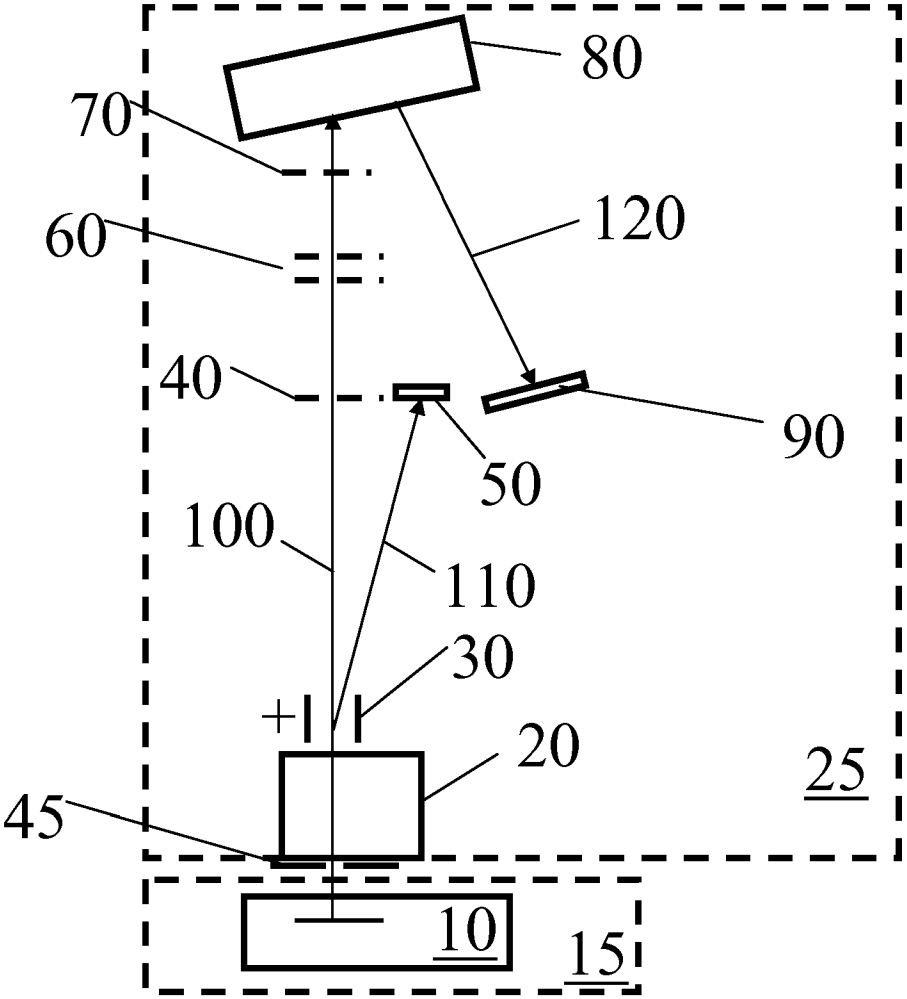
FIG. 2 is a schematic diagram of one embodiment of the MALDI-TOF-TOF mass analyzer of the present invention.

FIG. 2 illustrates another embodiment of the present invention. In this embodiment, the first timed-ion-selector 40, the pulsed accelerator 60, and the second timed-ion-selector 70 are aligned with the undeflected first ion path 100, and ions are directed along ion path 110 by energizing deflector 30 for measurement of MS spectra. In this embodiment the two-stage gridded ion mirror 80 is inclined at a small angle relative to the perpendicular of the first ion path 100 to direct reflected ions along the third ion path 120 to the second ion detector 90. The second ion detector 90 is oriented with its input surface parallel to mirror 80 in both FIG. 1 and FIG. 2 embodiments. The first and second ion detectors, 50 and 90, may comprise dual channel plate electron multipliers, having input and output surfaces.

Figure 3:
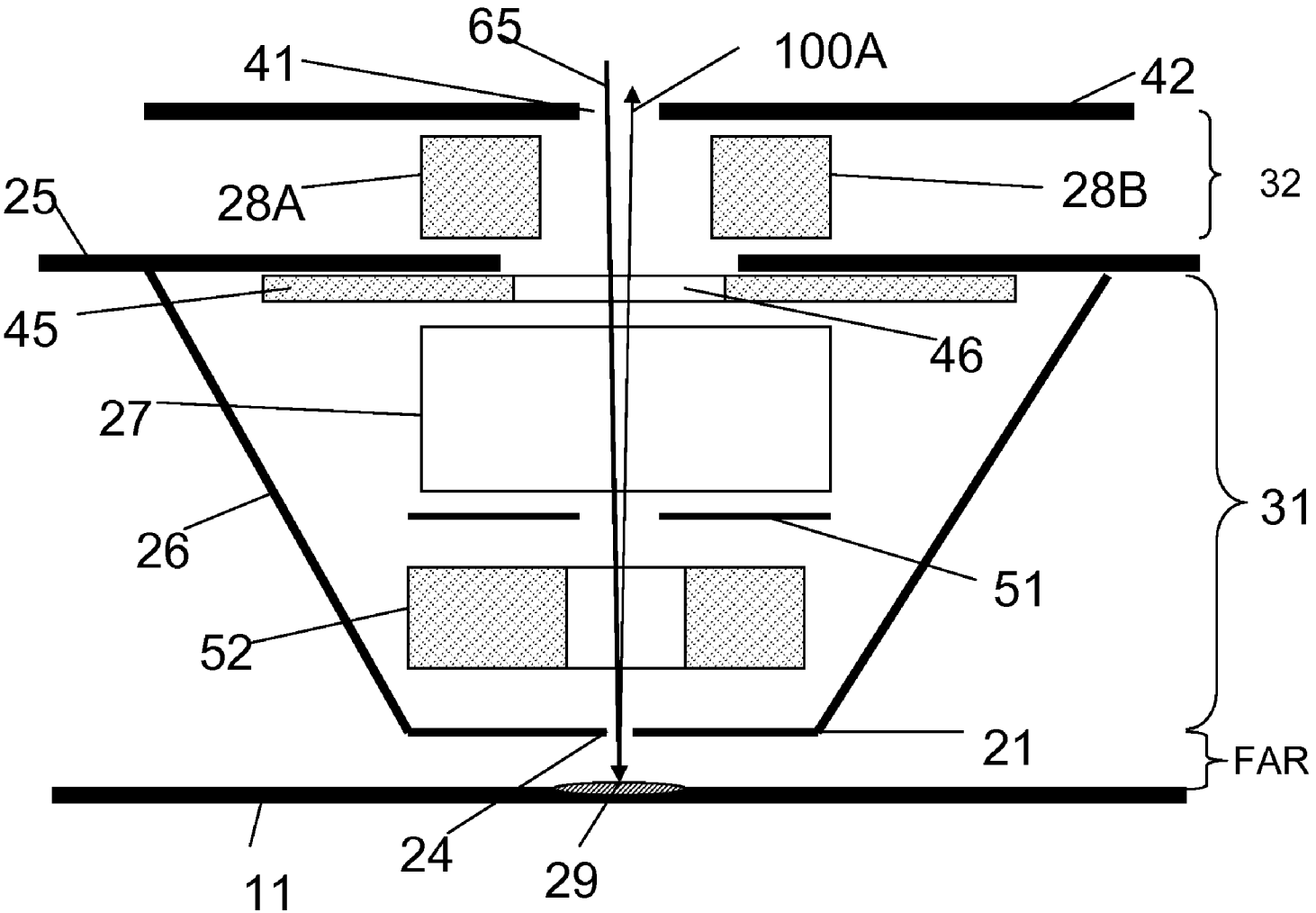
FIG. 3 is a cross-sectional expanded schematic diagram of a MALDI ion source region of the present invention.
Figure 4:
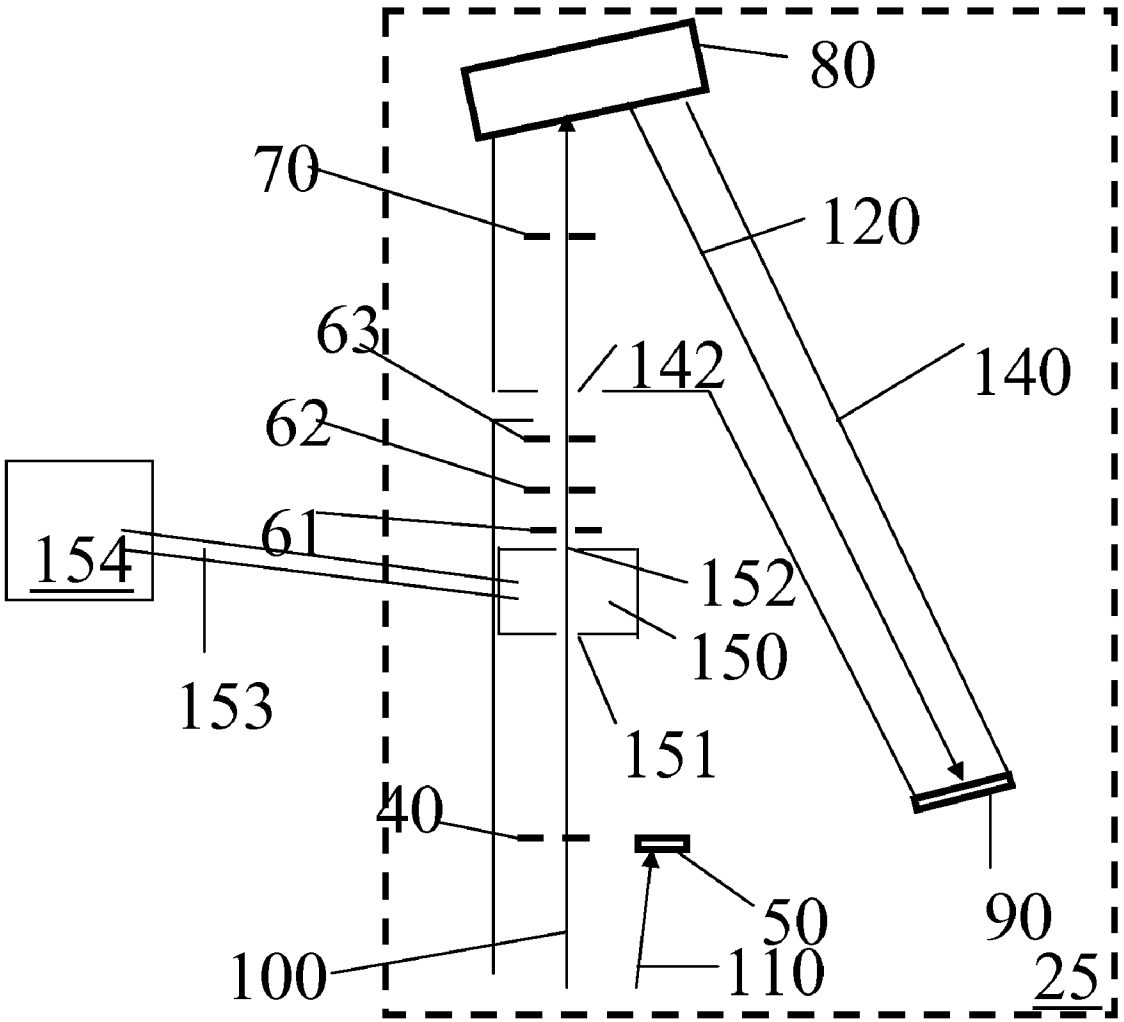
FIG. 4 is a detailed schematic of a portion of the embodiment illustrated in FIG. 2.
Figure 5:
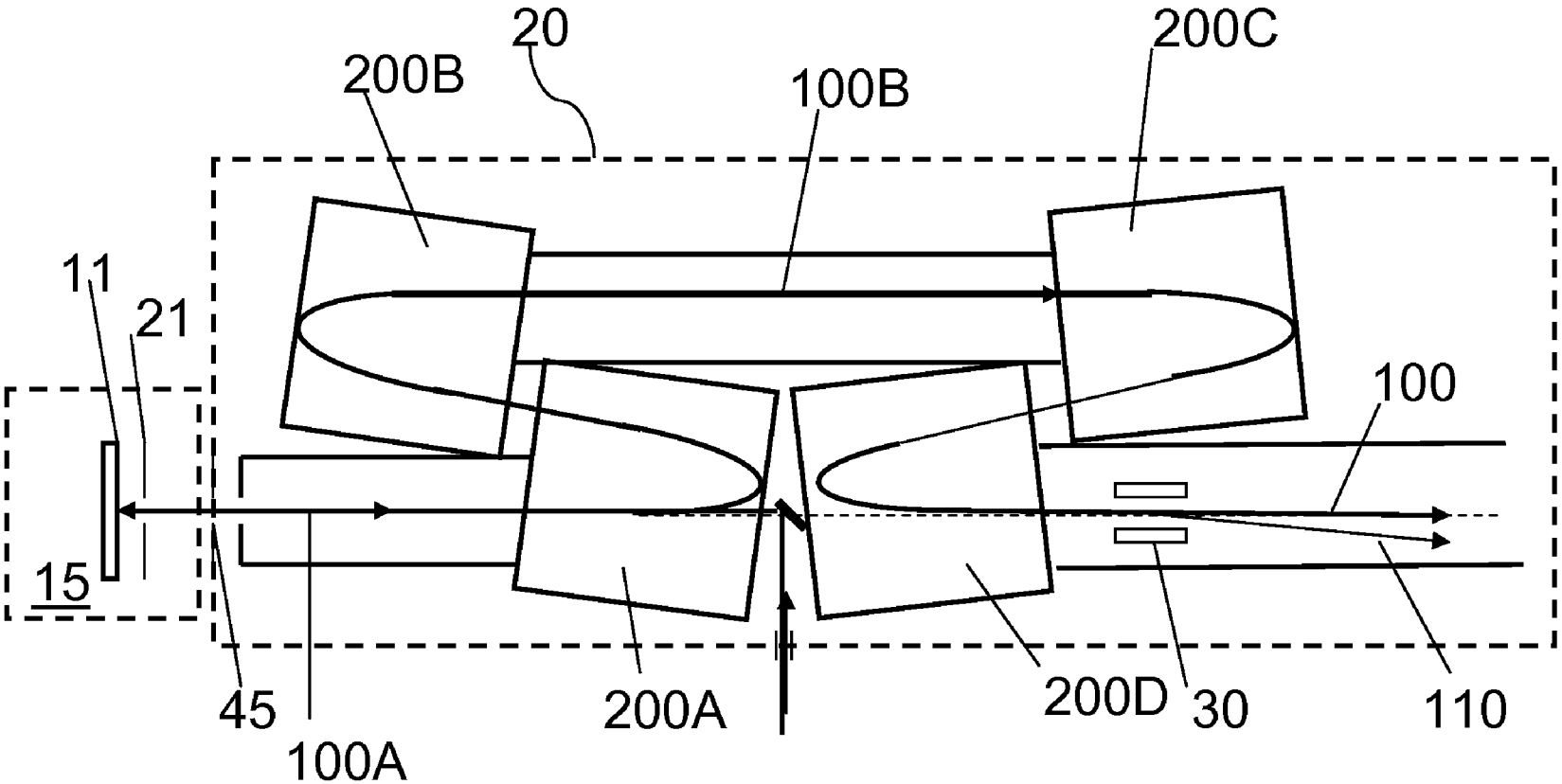
FIG. 5 is a schematic of an in-line energy corrector employed in the present invention.

Taken together FIGS. 3, 4, and 5 provide detailed schematics of the overall system illustrated in FIG. 2.

FIG. 3 shows cross-sectional detail of one embodiment comprising the first accelerating region ("FAR") between the MALDI sample plate 11 and the grounded extraction electrode 21, the portion of the first field-free region 31 between the extraction electrode 21 and the evacuated ion source housing 25, and the portion of the first field-free region 32 between the analyzer vacuum housing 25 and grounded electrode 42 (having aperture 41).

In some embodiments the first field-free region is enclosed in a grounded shroud 26. Included within the first field-free region are gate valve 45 (having aperture 46), and deflection electrodes 27 and 28. In the cross-sectional view 27A is below the plane of the drawing and 27B is above the plane of the drawing (not shown). Deflection electrodes 28A and 28B are located in the field-free region between the analyzer vacuum housing 25 and electrode 42.

Voltage may be applied to one or more of the electrodes, 27A, 27B, 28A, and 28B to deflect ions in the ion beam 100A produced by the pulsed laser beam 65 striking sample 29 deposited on the surface of the MALDI plate 11. A voltage difference between 27A and 27B deflects the ions in a direction perpendicular to the plane of the drawing, and a voltage difference between 28A and 28B deflects ions in the plane of the drawing. Voltages can be applied as necessary to correct for misalignments in the ion optics and to direct ions along a preferred path.

Electrodes 51 and 52 together with the extraction electrode 21 comprise an einzel lens that may be energized by applying voltage $V_L$ to electrode 52 to focus the ion beam 100A.

FIG. 4 is an expanded representation of a portion of the embodiment depicted in FIG. 2. Here, undeflected ion beam in the first ion path 100 passes through the first timed-ion-selector 40 and travels to the pulsed ion accelerator 60. The ion accelerator 60 (shown in FIGS. 1 and 2) comprises grounded grids 61 and 63 and an accelerator grid 62 connected to an external high voltage pulse generator (not shown). Fragment ions fragmenting generated along the path from in-line energy corrector 20 (FIG. 2) and accelerator 60 travel with substantially the same velocity as their precursor. The first timed-ion-selector may be energized at a predetermined time to allow a selected precursor ion mass, or range of masses, and all of the fragments produced from that precursor to be transmitted and cause all unselected precursor ions and their fragments to be deflected so that they are unable to reach the pulsed ion accelerator 60. Ions may fragment unimolecularly as the result of excitation of the ions in the ions source.

In one embodiment a collision cell 150 containing entrance aperture 151 and exit aperture 152 is placed in the path of the ion beam. A source of gas 154 is connected to the collision cell through a capillary tube 153 to raise the pressure of gas in the collision cell above the vacuum level in the analyzer housing 25. The pressure is raised sufficiently to cause the energetic collisions of ions with a neutral gas molecules thereby exciting the molecules and causing fragmentation.

In one embodiment a laser beam or other agent may be used to excite the molecules and cause fragmentation. At the predetermined time when a selected precursor ion and its fragment reach a predetermined location between grids 62 and 63 a high voltage pulse is applied to acceleration grid 62 causing its potential to switch from ground potential to a predetermined potential. The selected precursor and fragment ions are accelerated and pass through grid 63 and are further accelerated by a potential difference between grid 63 and shroud 140 that is connected to an external high voltage supply (not shown) and defines a second field-free drift space. Accelerated ions pass through aperture 142 in the shroud and are reflected by the two-stage ion mirror 80 and are detected by detector 90.

In one embodiment a second timed-ion-selector 70 is located within the field-free space defined by shroud 140. The second timed-ion-selector may be energized at a predetermined time following application of the high voltage pulse to acceleration grid 62 to transmit only a portion of the fragment ions and reject others. For example second timed-ion-selector 70 may be employed to reject any unfragmented precursor ions and transmit substantially all fragment ions, or alternatively it may be energized to transmit only a selected small portion of the fragment ions within a narrow mass range.

In one embodiment additional ion optical element such as focusing lenses and deflectors may be included within the field-free space defined by shroud 140 to efficiently direct fragment ions away from or toward the detector 90.

FIG. 5 provides a more detailed schematic of the in-line energy corrector 20. The in-line energy corrector comprises a set of four substantially identical two-stage ion mirrors 200A, 200B, 200C, and 200D arranged symmetrically about a centerline perpendicular to the nominal direction of ion beam 100A. The axes of mirrors 200A and 200B are parallel and offset from one another. These axes are inclined at a small angle to the ion beam 100A. Mirrors 200C and 200D are the mirror image of mirrors 200A and 200B. The potential applied to the mirrors are adjusted so that the ion beam 100B is displaced from beam 100A and is substantially parallel to 100A. Ion beam 100B is reflected by mirrors 200C and 200D and the exiting ion beam 100 is substantially co-axial with ion beam 100A. The displacement of beam 100B relative to 100A is dependent on the kinetic energy of the ions, but ion beam 100 is substantially co-axial with beam 100A independent of the kinetic energy within the range transmitted by the mirrors. The potentials applied to the mirrors and the length of the mirrors is chosen so that transmitted ions are focused in time either at the first timed-ion-selector 40 or first ion detector 50 depending on whether the energizing deflector 30 is energized to direct ions to the first ion detector 50 or the first timed-ion-selector 40.

Figure 6:
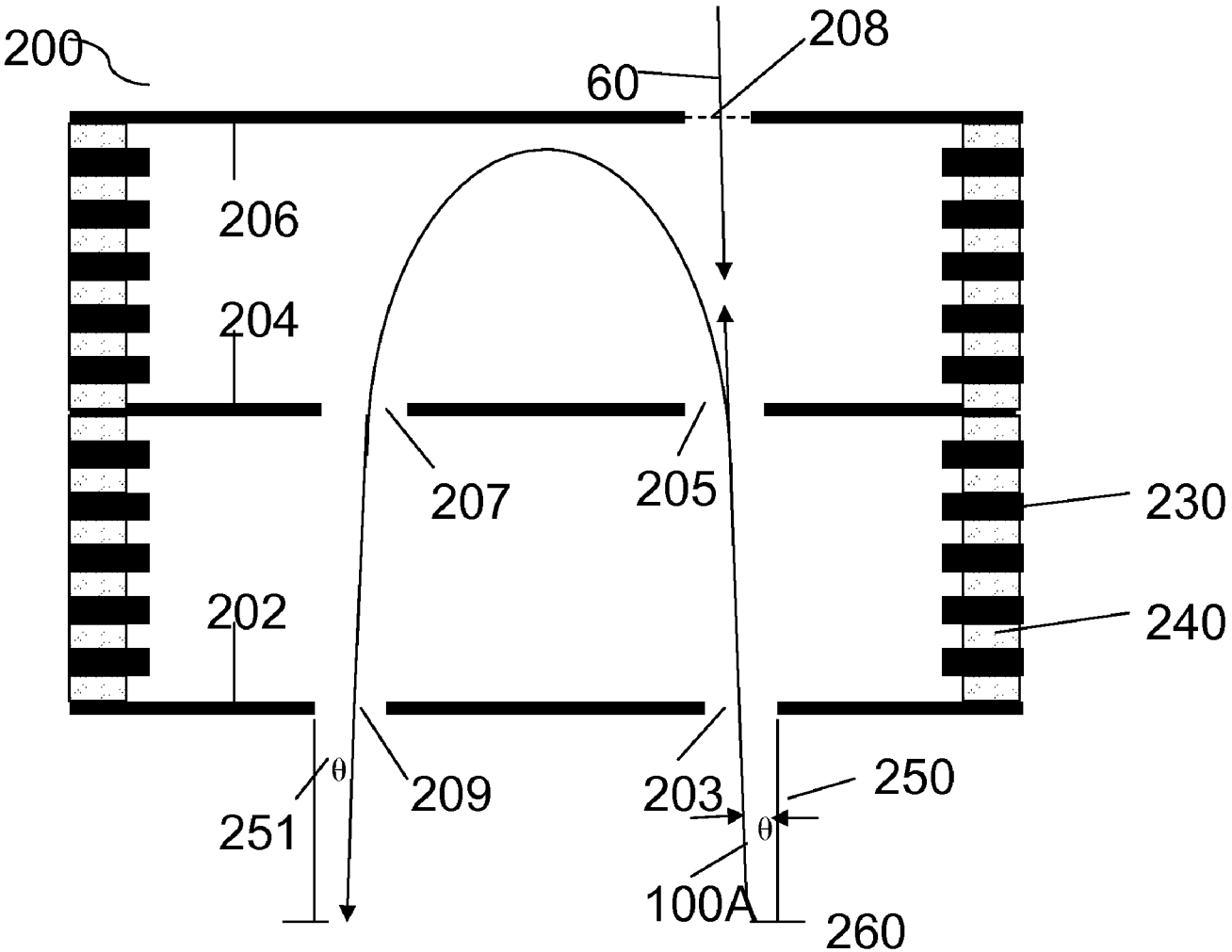
FIG. 6 is a schematic diagram of a two-stage gridless ion mirror employed in a preferred embodiment of the in-line energy corrector.

One configuration of an ion mirror 200 employed in the in-line energy corrector 20 is illustrated in FIG. 6. Any type of ion reflector (i.e., mirror) known in the art including single-stage gridded, two-stage gridded, and two-stage gridless may be employed. FIG. 6 illustrates a preferred embodiment employing a two-stage gridless reflector.

In operation an ion beam enters the reflector through aperture 203 in first mirror plate 202 at a small angle θ 250 relative to a perpendicular 260 to plate 202. Potentials are applied to plates 204 and 206 causing the ions to pass through aperture 205 in plate 204 and be reflected back through aperture 207 in plate 204 and 209 in plate 202 and exits reflector 200 along a trajectory at an angle 251 relative to perpendicular 260 that is equal in degree but opposite in direction to angle 250. A set of substantially identical electrodes 230 and insulators 240 are stacked as illustrated in FIG. 6 to make electrodes 202, 204, and 206 substantially parallel. Resistive dividers (not shown) are connected between plates 202 and 204 and between 204 and 206 to provide substantially uniform electrical fields between plates 202 and 204 and between 204 and 206. Each of the reflectors (mirrors) 200A, 200B, 200C, and 200D use the same design and a HV supply (not shown) provides potential to the electrodes 204. A second HV supply provides potential to all of the electrodes 206. Reflector 200A comprises a small aperture 208 covered by a grid in plate 206 allowing the laser beam to enter substantially co-axial with ion beam 100A and strike sample plate 11 as shown in FIG. 5.

In one embodiment the electrical field between electrodes 204 and 202 is between 2 and 4 times the electrical field strength between electrodes 206 and 204.

Figure 7:
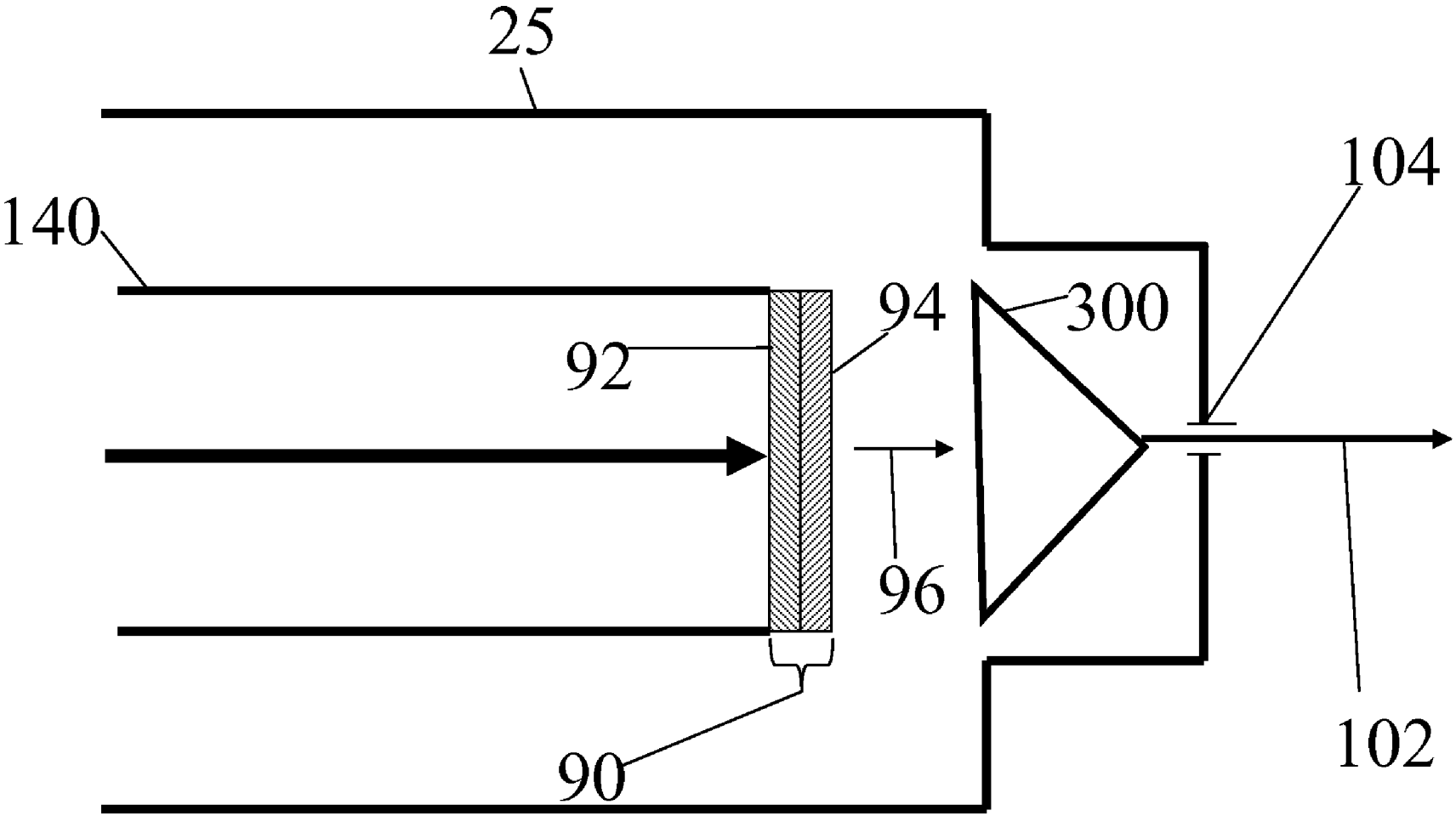
FIG. 7 is a schematic diagram of the detector employed in some embodiments of the invention.

FIG. 7 is an expanded view of one embodiment of the detector 90. The detector 90 comprises a dual channel plate electron multiplier mounted directly to the shroud 140 with the output side of the channel plate assembly 94 biased at 1.6 to 2 kV positive relative to the input side 92. The anode 300 is connected via lead 102 through vacuum feedthrough 104 to ground potential through a 50 ohm resistor (not shown) and is spaced far enough (ca 10 mm) from the channel plate to support the large voltage difference of ca. 8 kV. This novel detector arrangement is a preferred alternative to capacitive or inductive coupling of signal to ground from an anode at high potential as employed in prior art.

Figure 8:
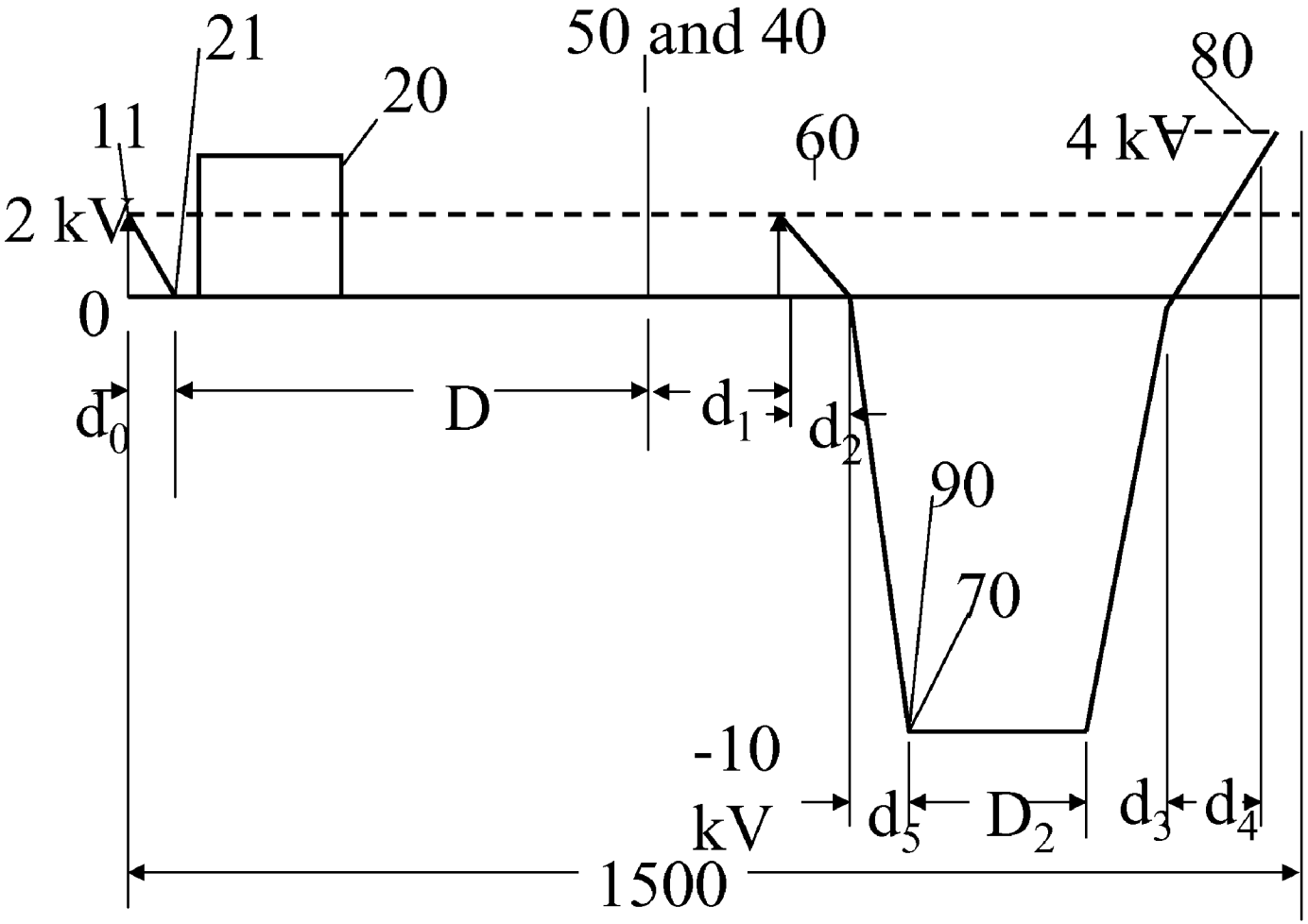
FIG. 8 is a partial potential diagram for certain embodiments of the invention.

FIG. 8 shows a potential diagram for one embodiment. In this embodiment the ions are accelerated to approximately 2 kV by application of a pulse to sample plate 11. Selected precursor ions and associated fragments are accelerated by a second 2 kV pulse applied to grid 62 in the accelerator 60. Precursor and fragment ions are further accelerated by a potential of −10 kV applied to shroud 140 and appropriate potentials are applied to two-stage reflector 80 to focus ions at the detector 90. Detector 90 and second timed-ion-selector 70 are biased at the same potential as shroud 140 as indicated schematically in FIG. 8. The voltages and distance are chosen to optimize the overall performance of the instrument. A set of nominal distance for one embodiment are summarized in Table 1.

TABLE 1

Values for distance parameters

| | | Distance (mm) |
|---|---|---|
| Source field length | $d_0$ | 1 |
| Source exit toTIS | D | 1100 |
| TIS to Second Source | $d_1$ | 100 |
| Gnd. Grid to pulsed grid | n.s. | 2 |
| Second source 1st field length | $d_2$ | 8 |
| Second source 2nd field length | $d_5$ | 10 |
| 2nd source exit to mirror entrance | $D_{21}$ | 305 |
| Mirror first stage | $d_3$ | 37.5 |
| Mirror second stage | $d_4{}^0$ | 30 |
| Mirror exit-Detector | $D_{22}$ | 600 |
| Effective Length Corrector | $D_{ec}$ (n.s.) | 500 |

A preferred embodiment of the invention provides approximate optimization of several important specifications. These include resolving power of precursor selection in MS-1; resolving power and mass accuracy in MS measurements; resolving power and mass accuracy in MS-2; performance in multiplex mode; and sensitivity in both MS and MS-MS operation.

Resolving Power and Mass Accuracy in MS Mode.

The various contributions to peak width in TOF MS can be summarized as follows: (expressed as Δm/m)

First order dependence on initial position $$R_{s1}=[(D_v-D_s)/D_e](\delta x/d_0) \quad (1)$$

Where $D_e$ is the effective length of the analyzer, δx is the uncertainty in the initial position, $d_0$ is the length of the single-stage ion accelerator, and $D_v$ and $D_s$ are the focal lengths for velocity and space focusing, respectively, and are given by $$D_s=2d_0 \quad (2)$$

$$D_v=D_s+(2d_0)^2/(v_n{}^*\Delta t)=6d_0 \quad (3)$$

where Δt is the time lag between ion production and application of the accelerating field, and $v_n{}^*$ is the nominal final velocity of the ion of mass m* focused at $D_v$. $v_n{}^*$ is given by $$v_n{}^*=C_1(V/m^*)^{1/2} \quad (4)$$

The numerical constant $C_1$ is given by $$C_1=(2z_0/m_0)^{1/2}=2\times1.60219\times10^{-19}\ \text{coul}/1.66056\times10^{-27}\ \text{kg}=1.38914\times10^4 \quad (5)$$

For V in volts and m in Da (or m/z) the velocity of an ion is given by $$v=C_1(V/m)^{1/2}\ \text{m/sec} \quad (6)$$

and all lengths are expressed in meters and times in seconds. It is numerically more convenient in many cases to express distances in mm and times in nanoseconds. In these cases $C_1=1.38914\times10^{-2}$.

The time of flight is measured relative to the time that the extraction pulse is applied to the source electrode. The extraction delay Δt is the time between application of the laser pulse to the source and the extraction pulse. The measured flight time is relatively insensitive to the magnitude of the extraction delay, but jitter between the laser pulse and the extraction pulse causes a corresponding error in the velocity focus. In cases where Δt is small, this can be a significant contribution to the peak width. This contribution due to jitter $\delta_j$ is given by $$R_\Delta=2(\delta_j/\Delta t)\backslash(\delta v_0/v_n{}^*)(D_v-D_s)/D_e=2(\delta_j\delta v_0/D_e)[(D_v-D_s)/2d_0]^2 \quad (7)$$

and is independent of mass.

With time lag focusing the first order dependence on initial velocity is given by $$R_m=[(4d_0)/D_e](\delta v_0/v_n)[1-(m/m^*)^{1/2}]=R_{v1}(0)[1-(m/m^*)^{1/2}] \quad (8)$$

Where $\delta v_0$ is the width of the velocity distribution. At the focus mass, m=m*, the first order term vanishes.

With first order focusing the velocity dependence becomes $$R_{v2}=2[(2d_0)/(D_v-D_s)]^2(\delta v_0/v_n)^2 \quad (9)$$

And with first and second order velocity focusing the velocity dependence becomes $$R_{v3}=4[(2d_0)/(D_v-D_s)]^3(\delta v_0/v_n)^3 \quad (10)$$

The dependence on the uncertainty in the time measurement δt is given by $$R_t=2\delta t/t=(2\delta t C_1/D_e)(V/m)^{1/2} \quad (11)$$

A major contribution to δL is often the entrance into the channel plates of the detector. If the channels have diameter d and angle a relative to the beam, the mean value of δL is d/2 sin α. Thus this contribution is $$R_L=d/(D_e \sin\alpha) \quad (12)$$

Noise and ripple on the high voltage supplies can also contribute to peak width. This term is given by $$R_V=\Delta V/V \quad (13)$$

where ΔV is the variation in V in the frequency range that effects the ion flight time.

It is obvious from these equations that increasing the effective length of the analyzer increases the resolving power, but some of the other effects are less obvious.

The total contribution to peak width due to velocity spread is given by $$R_v=R_m+(\Delta D_{12}/D_e)R_{v2}+[(D_e-\Delta D_{12})/D_e]R_{v3} \quad (14)$$

where $\Delta D_{12}$ is the absolute value of the difference between $D_{v1}$ and $D_{v2}$. Assuming that each of the other contributions to peak width is independent, the overall resolving power is given by $$R^{-1}=[R_\Delta^2+R_{s1}^2+R_v^2+R_t^2+R_L^2+R_V^2]^{-1/2} \quad (15)$$

Optimization of MS-1.

As illustrated in FIG. 8 and using the parameters summarized in Table I, the effective length $D_e$ of the MS-1 analyzer is approximately 1600 mm and the accelerating voltage is 2 kV For a reflecting analyzer with first and second order focusing the terms limiting the maximum resolving power are $R_{s1}$, $R_{v3}$, and $R_t$. The variation of resolving power with mass is determined primarily by $R_{v1}$ and may also be affected by $R_t$. In terms of the dimensionless parameter $K=2d_0/(D_v-D_s)$ the major contributions can be expressed as $$R_{s1}=2K^{-1}[\delta x/D_e] \quad (16)$$

$$R_{v3}=4K^3(\delta v_0/v_n)^3 \quad (17)$$

$$\text{And } R^2=4K^{-2}[\delta x/D_e]^2+16K^6(\delta v_0/v_n)^6 \quad (18)$$

The minimum value of $R^2$ corresponds to $d(R^2)dK=0$ $$-8K^{-3}[\delta x/D_e]^2+96K^5(\delta v_0/v_n)^6=0$$

$$K^8=(1/12)[\delta x/D_e]^2(\delta v_0/v_n)^{-6}$$

$$K=0.733\{[\delta x/D_e]/(\delta v_0/v_n)^3\}^{1/4} \quad (19)$$

For one embodiment $[\delta x/D_e]=0.01/1600=6.25\times10^{-6}$, $(\delta v_0/v_n)^3=(0.0004/0.0113)^3=4.4\times10^{-5}$ K=0.45. For the embodiment described above K=0.5; very close to the optimum. In the more general case $$K=12^{-1/8}(De)^{-1/4}\{[\delta x\, C_1^3(\delta v_0)^{-3}\}^{1/4}(V/m^*)^{3/8} \quad (20)$$

For the geometry given with the in-line energy corrector adjusted to provide second order focusing the contributions to peak width are given by $$R_{s1}=(4/1600)(0.01/1)=2.5\times10^{-5}\ R_{s1}^{-1}=40{,}000$$

$$R_{v1}=[4/1600](0.02m^{1/2})=5\times10^{-5}m^{1/2}\ R_{v1}^{-1}=20{,}000m^{-1/2}$$

$$R_{v3}=(2/4)^3(0.02m^{1/2})^3=1\times10^{-6}m^{3/2}\ R_{v3}^{-1}=1\times10^6\ m^{-3/2}$$

$$R_t=m^{-1/2}[2(1.5)(0.02)]/1600]=3.75\times10^{-5}m^{-1/2}$$
$$R_t^{-1}=26{,}700m^{1/2}$$

Figure 9:
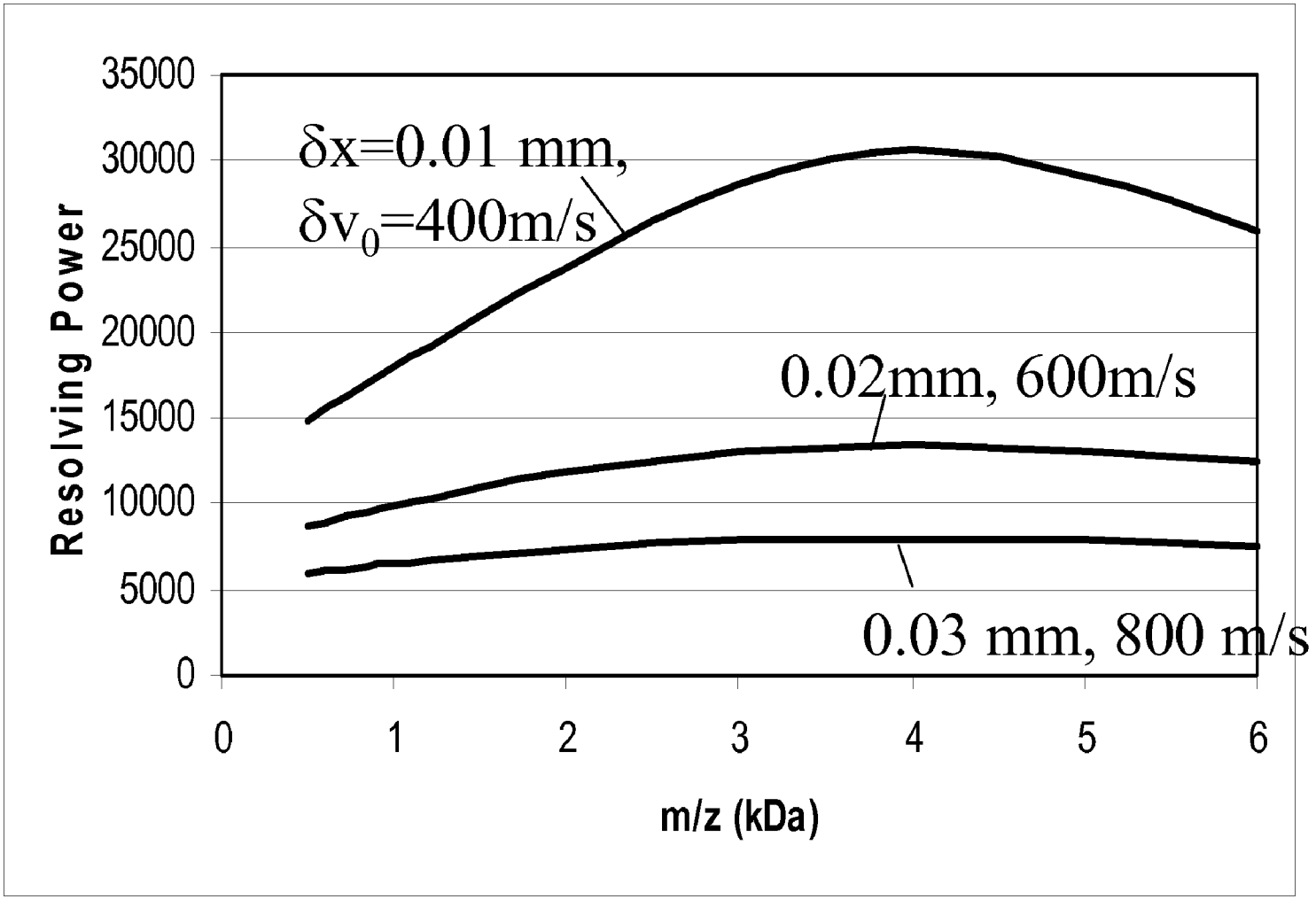
FIG. 9 is a plot of calculated resolving power for MS-1 as function of m/z for a first accelerating region 1 mm long for different values of the initial distribution of velocity and position of the ions formed in a MALDI ion source. Values are $D_e$=1600 mm, d1=1 mm, V=2 kV, focused at 4 kDa showing dependence on initial conditions.
Figure 10:
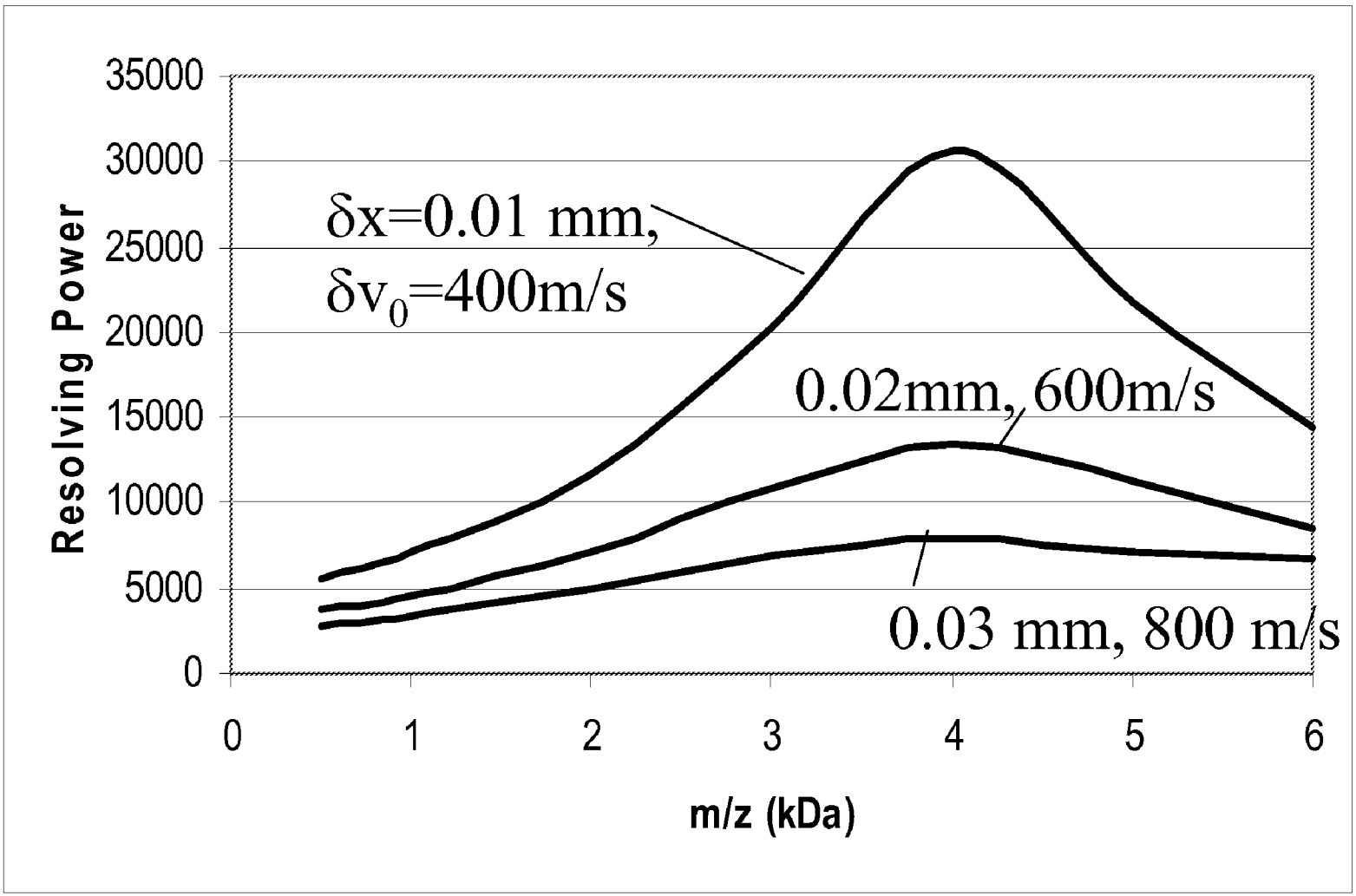
FIG. 10 is a plot of the calculated resolving power for MS-1 as function of m/z with a first accelerating region 3 mm long for different values of the initial distribution of velocity and position of the ions formed in a MALDI ion source. Values are $D_e$=1600 mm, $d_1$=3 mm, V=2 kV, focused at 4 kDa showing dependence on initial conditions.

Calculation of the overall resolving power as function of m/z for the delay chosen for first order focus at m/z=4 kDa is shown in FIG. 9 for a source length $d_0$=1 mm as shown in Table I. The upper curve corresponds to initial values of $\delta v_0$ and $\delta x$ typical for operating a relatively low laser intensities typically used in MS operation. The lower curves corresponding to hypothetical values of these parameters that may occur with the use of substantially higher laser intensities as are typically used in MS-MS mode. Similar results for an identical analyzer except that the system is optimized for a source length of 3 mm are shown in FIG. 10. As can be seen from the figures, the maximum resolving power is essentially unaffected by the choice of source length, but the dependence on mass is much more pronounced with the longer length. Thus it is clear that the best choice is to make the source as short as possible limited only by the distance required to prevent electrical discharges between the sample plate and the extraction electrode.

Resolving Power for Precursor Selection

Since the effective distance to the timed-ion-selector is substantially the same as that to the MS detector, the resolving power is reduced only as the result of using higher laser intensity and the fact that the time resolution of the selector may be different from that of the multiplier and digitizer. The estimated time resolution of the selector is not worse than 10 nsec. There for the maximum value of $R_t$ is $$R_t=m^{-1/2}[2(5)(0.02)]/1600]=1.25\times10^{-4}m^{-1/2}\ R_t^{-1}=8{,}000m^{1/2}$$

And assuming that the lower curve in FIG. 9 is a reasonable "worst case" then the resolving power for precursor selection is expected to be greater than 5000 over the entire range from 0.5 to 6 kDa.

For a given set of initial conditions there is a trade-off between resolving power for precursor selection and resolving power in MS-2. The best resolution in MS-2 is obtained when the focal distance for the source in MS-1 is made as long as possible consistent with achieving the desired resolving power for precursor selection. This makes the velocity spread at the MS-2 accelerator smaller thus improving the resolving power. A reasonable estimate for the initial conditions in MS-MS mode is $\delta v_0$=800 m/s=0.0008 mm/nsec, $\delta x$=0.02 for the following two focal conditions, Case I, $D_v-D_s$=4; Case II, $D_v-D_s$=16. Then for the geometry described above, the values would be as shown in Table 2.

Figure 11:
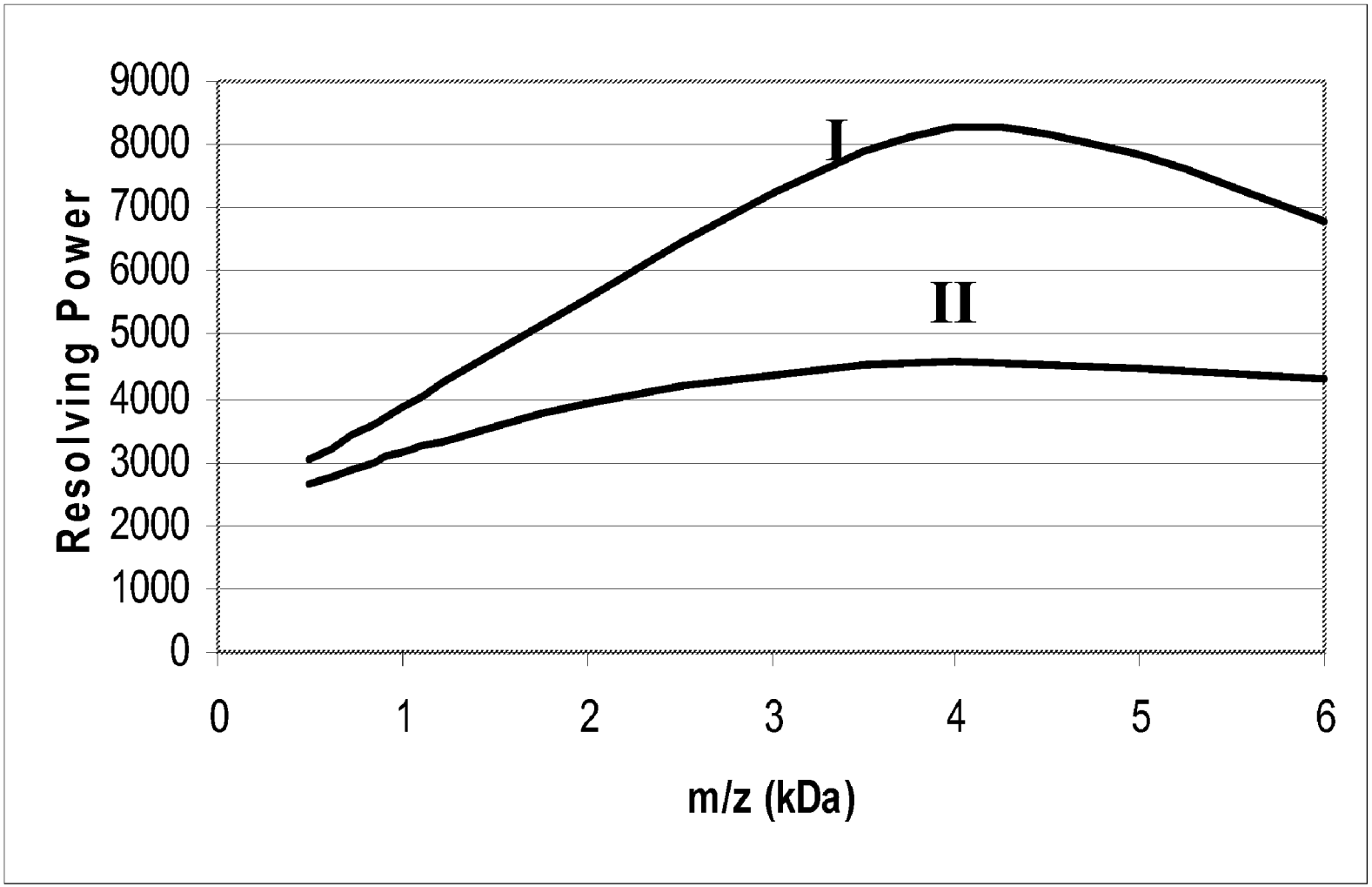
FIG. 11 is a plot of the calculated resolving power for precursor selection. Case I corresponds to a short focal length for first order focusing of the ion source and Case II corresponds to longer focal length.

The calculated resolving power as a function of m/z for focus at 4 kDa for these two cases is shown in FIG. 11. The maximum resolving power is reduced by increasing the source focus, but the target value is achieved over the mass range of interest, and as shown below the performance of MS-2 is much better for Case II.

TABLE 2

| Geometry values | | |
|---|---|---|
| | Case I | Case II |
| $R_{s1}$ | $5\times10^{-5}$ | $2\times10^{-4}$ |
| $R_{v3}$ | $8.4\times10^{-6}$ m$^{3/2}$ | $1.3\times10^{-7}$ m$^{3/2}$ |
| $R_t$ | $1.25\times10^{-4}$ m$^{-1/2}$ | $1.25\times10^{-4}$ m$^{-1/2}$ |
| $R_{v1}$ | $2\times10^{-4}$ m$^{1/2}$ | $2\times10^{-4}$ m$^{1/2}$ |
| $R^{-1}$ (m = 4 kDa) | 9570 | 4770 |

Resolving Power of MS-2

The relative velocity spread of the ions following tme lag focusing is given by $$\delta v/v=\delta v_0\Delta t/2d_0=[2d_0/(D_v-D_s)](\delta v_0/v) \quad (21)$$

The ions are focused at the timed-ion-selector and disperse as they travel on to the second source. The spread in position at the second source is given by $$\delta x_2=d_1(\delta v/v) \quad (22)$$

And the velocity spread after acceleration in the second source is given by $$\delta v_2/v_2=(\delta x_2/2d_2y_2)=(d_1/2d_2y_2)[2d_0/(D_v-D_s)](\delta v_0/v) \quad (23)$$

Where $y_2$=7 for the voltages shown in FIG. 8.

Case I and Case II—Effect of Focus

Using the parameter values summarized in Table 1, the source focus is only first order, but for precursor ions the reflector can be adjusted to provide both first and second order focusing between the source focus and the detector. The source focal points are given by $$D_{s2}=2d_2y_2^{3/2}[1-(d_5/d_2)/(y_2+y_2^{1/2})]=258 \quad (24)$$

$$D_{v2}-D_{s2}=[(2d_2y_2)^2/d_1](v/v_2)=[(2d_2)^2y_2^{3/2}/d_1](m_f/m_p)^{1/2}=47.4(m_f/m_p)^{1/2} \quad (25)$$

Where $m_f$ is the mass of a fragment and $m_p$ is the mass of the precursor. Thus the source focal length for precursor ions is 305.4 mm and decreases with fragment mass as shown by equation (25).

The conditions for simultaneous first and second order focusing of the two-stage mirror are given by $$4d_3/D_m=1\text{-}3/w \quad (26)$$

$$4d_4/D_m=w^{-3/2}+(4d_3/D_m)/(w+w^{1/2}) \quad (27)$$

where $D_m$ is the total length of the ion path from the focal point to the mirror entrance $D_{21}$ plus the path from the mirror exit to the detector surface $D_{22}$, $d_3$ is the length of the first region of the mirror, $d_4$ is the distance than an ion with initial energy V penetrates into the second region of the mirror and $w=V/(V-V_1)$ is the ratio of the ion energy at the entrance to the mirror to that at the entrance to the second region with the intermediate electrode at potential $V_1$. Thus, first and second order focusing can be achieved for any value of w>3, and the corresponding distance ratios are uniquely determined by equations (24) and (25). In this case $D_m$=600 mm, w=4, $d_3$=37.5, $d_4=(2/3)d_3$, $V_1$=0.75V, $V_2$=1.05V. The total effective length of the mirror is $1.5D_m$; and the effective length of the source is $$D_{es2}=2d_2y_2^{1/2}[1+(d_5/d_2)/(y_2^{1/2}+1)]=56.6 \quad (28)$$

And the total effective distance to the source focus is 362 mm and the overall effective length of the analyzer is $D_e$=1262 mm. The major contributions to peak width for precursor ions are $$R_{v2}=2(362/1262)(\delta v_2/v_2)^2 \quad (29)$$

$$R_{v3}=2(900/1262)(\delta v_2/v_2)^3 \quad (30)$$

$$R_t=2\delta t/t=(2\delta tC_1/D_e)(V/m)^{1/2}=1.24x^{-4}m^{-1/2}$$
$$R_t^{-1}=8000m^{1/2} \quad (31)$$

Since the contributions due to velocity spread are not independent, these are added together and combined with other contributions using square root of the sum of the squares as described above. For the two cases considered above for estimating precursor resolution we have $$\text{Case I; } \delta v_2/v_2=(\delta x_2/2d_2y_2)=(d_1/2d_2y_2)[2d_0/(D_v-D_s)](\delta v_0/v)=(100/112)(1/2)(0.04)m^{1/2}=0.0179m^{1/2} \quad (32)$$

$$\text{Case II: } \delta v_2/v_2=0.00446m^{1/2} \quad (33)$$

And the corresponding contributions to peak width are $$\text{Case I: } R_v=0.574(0.0179)^2m+1.43(0.0179)^3m^{3/2}=1.84\times10^{-4}m+8.2\times10^{-6}m^{3/2} \quad (34)$$

$$\text{Case II: } R_v=1.14\times10^{-5}m+1.27\times10^{-7}m^{3/2} \quad (35)$$

Figure 13:
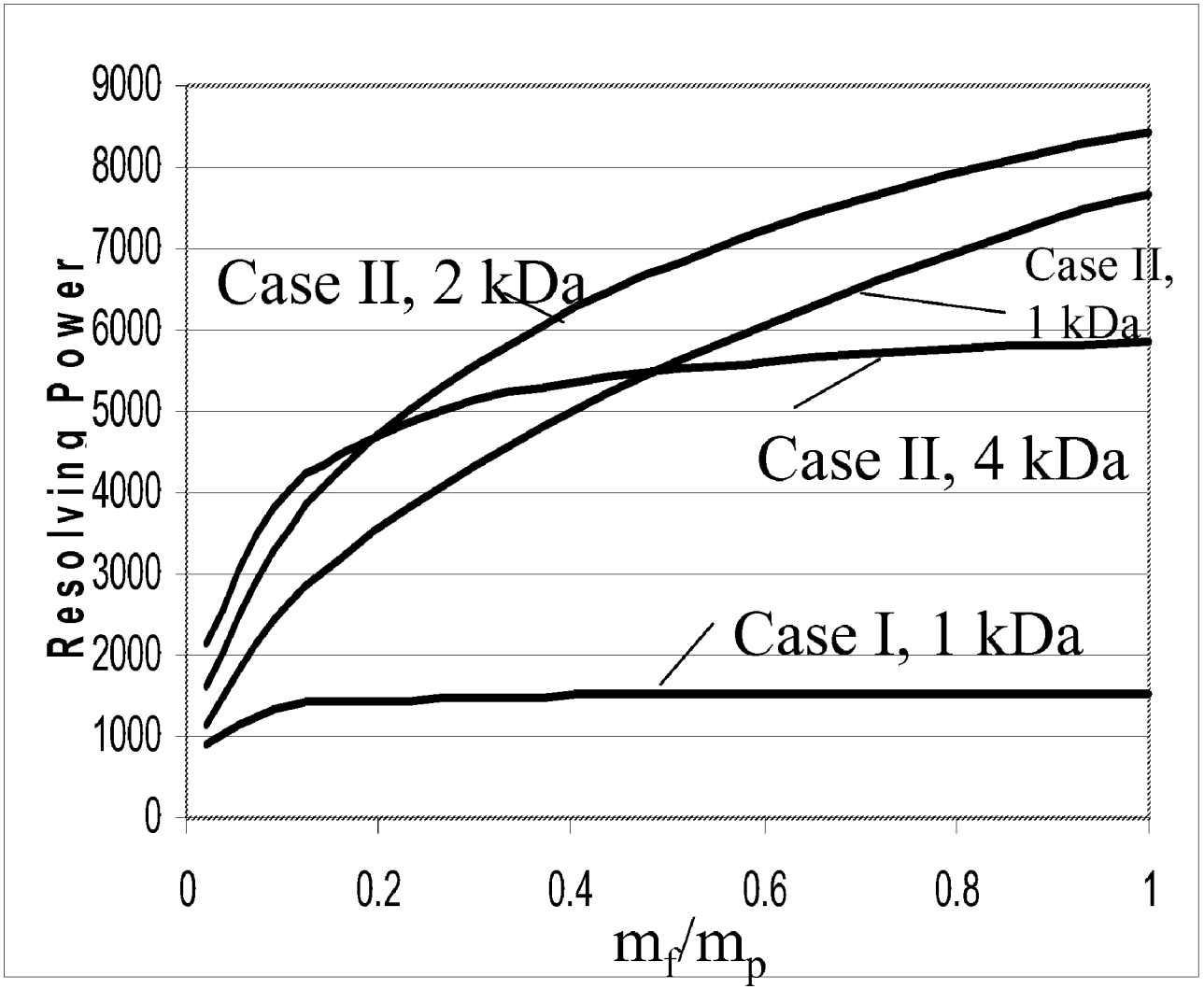
FIG. 13 is a plot of the calculated resolving power as a function of $m_f/m_p$ for MS-2 for different precursor masses and comparing the results corresponding to Cases I and II of FIG. 11.

And for m=4 kDa, the resolving power limits due to velocity spread are respectively $R_v^{-1}$=1250 for case I, and 21,450 for case II. Resolving powers for the two cases as a function of mass are shown in FIG. 13 where the effect of time resolution has been included. The effect of velocity spread is even more pronounced for fragment ions.

The first and second order focal lengths for a two-stage mirror are $$D_{m1}=4d_4w^{3/2}+4d_3[w/(w-1)][1-w^{1/2}] \quad (36)$$

$$3D_{m2}=4d_4w^{5/2}+4d_3[w/(w-1)][1-w^{3/2}] \quad (37)$$

After acceleration in the second source the energy of the fragment mass is reduced by the energy lost with the neutral fragment in the fragmentation process. Equations (26) and (27) are derived by setting these focal distances equal, but if the ion energy is different from the value corresponding to the focusing conditions, then these vary independently. The energy of ions after acceleration in the second ion accelerator is given by $$V_T(m_f)=V_a+V_{s2}(1-x/d_2)-V(1-m_f/m_p) \quad (38)$$

and V is the potential energy of the ions in MS-1, $V_{s2}$ is the amplitude of the voltage pulse in source 2, and $V_a$ is the potential difference across the second accelerating region in source 2. $x=vt_2-d_1$ is the distance that a selected ion enters into source 2 at the time $t_2$ that the accelerating pulse is applied. If we define $$\alpha=-(1-m_f/m_p)V/[V_a+V_1(1-x/d_2)] \quad (39)$$

$$V_T(m_f)=V_T(m_p)(1+\alpha) \quad (40)$$

Then for the case described above where first and second order focusing are achieved for precursor ions with w=4 the focal lengths as a function of $m_f$ are determined by setting $$w=(1+\alpha)/(0.25+\alpha) \quad (41)$$

$$d_4=(2/3)d_3(0.25+\alpha) \quad (42)$$

Figure 12:
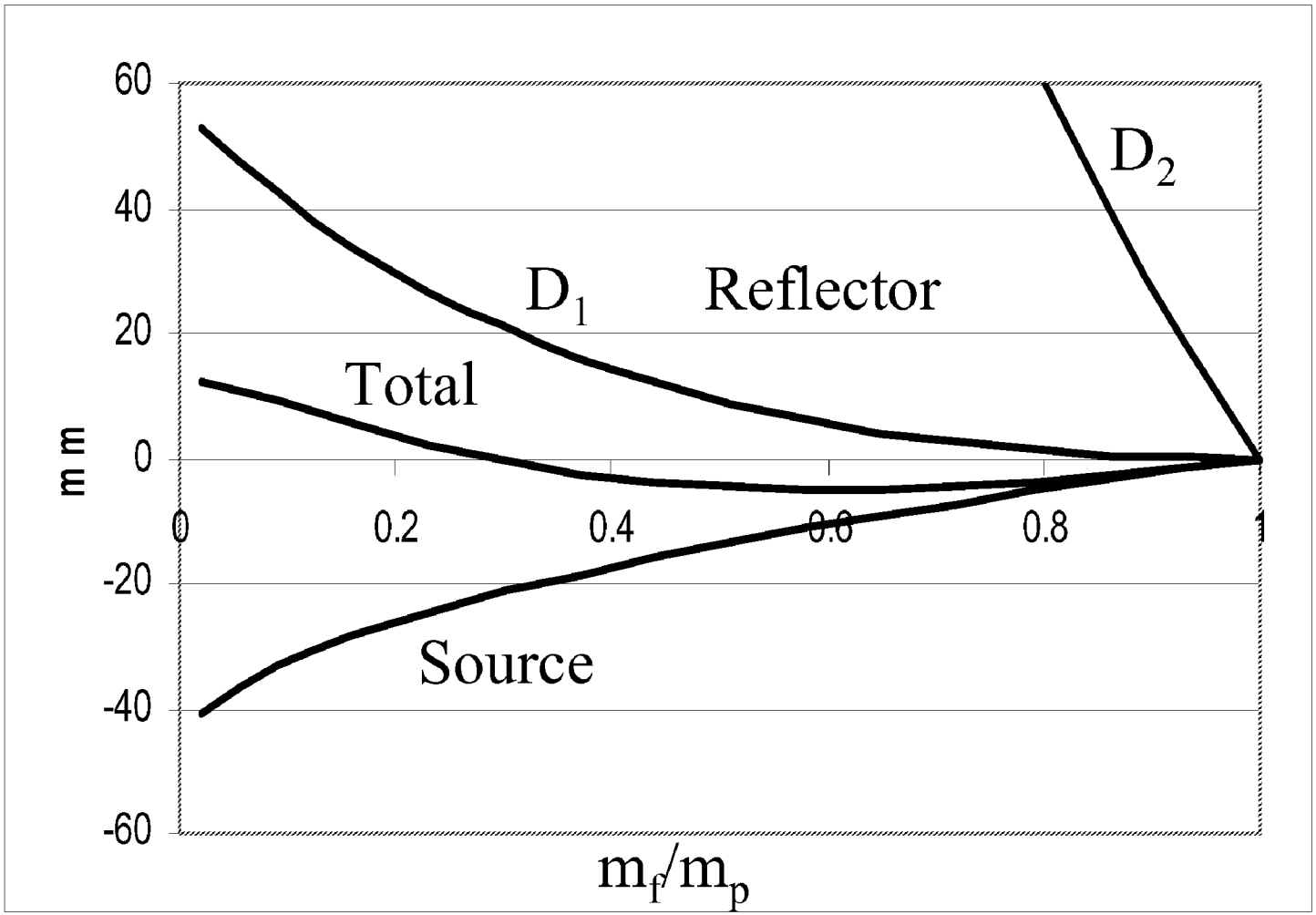
FIG. 12 is a plot of the calculated deviation in first and second order focal lengths as a faction of fragment mass to precursor mass ratio, $m_f/m_p$, for a two-stage reflector ($D_1$ and $D_2$); first order focal length for a two-stage ion accelerator (source); and the sum of the first order focal lengths for the reflector and accelerator (Total).

The focal lengths of the reflector as a function of $m_f/m_p$ can be calculated by inserting (41) and (42) into (36) and (37). Results are shown in FIG. 12 where the change in first order focal length is opposite to that from the source so that the differences partially cancel. On the other hand, the second order focal length increases very rapidly as $m_f/m_p$ decreases so that, except for the precursor ion and fragments with $m_f/m_p$ close to unity the limiting peak width is determined by $R_{v2}$. An additional contribution to peak width is contributed by the error in focal length. This is given by $$R_R=2(\Delta D/D_e)(\delta v_2/v_2) \quad (43)$$

Where ΔD is the difference in first order focal length as shown in FIG. 12. Except at very low mass the maximum value of ΔD is less than 6 mm. Thus for the two cases the maximum contributions to peak width due to this effect are $$\text{Case I: } R_R=[2(6)/1262](0.0179)=1.7\times10^{-4}m_p^{1/2} \quad (44)$$

$$\text{Case II. } R_R=4.26\times10^{-5}m_p^{1/2} \quad (45)$$

In all cases this contribution is small compared to the limiting value primarily determined by $R_t$ for Case II and by $R_{v2}$ for Case I. Calculated resolving power as a function of fragment mass for several precursor masses is shown in FIG. 13 for each of these cases. Clearly, Case II provides satisfactory performance for both precursor selection and for MS-2 and Case I does not.

Calibration of MS-1

With first and second order focusing the flight time is proportional to the square root of the mass except for the time spent in the ion source that depends on the initial velocity. Thus the total flight time with a single field source and a two-stage mirror is given by $$t-t_0=(D_e/v_n)[1-2d_0v_0/(D_ev_n)]=Am^{1/2}[1-Bm^{1/2}]=X \quad (46)$$

where the default values of the constants are $$A=D_e/CV^{1/2}\ B=(2d_0/D_e)(v_0/CV^{1/2}) \quad (47)$$

This equation can be inverted using the quadratic formula to give an explicit expression for mass as a function of flight time.

$$m^{1/2}=(2B)^{-1}[1-(1-4BX/A)^{1/2}] \quad (48)$$

Higher order terms may become important if a very wide mass range is employed. A higher order correction can be determined by the following procedure.

$$Z(m)=[(t-t_0)/\{Am^{1/2}(1-Bm^{1/2})\}]=1-C(m-m_0) \quad (49)$$

If a significant systematic variation of Z with m is observed, then the results are fitted to an explicit function, such as given in equation (49). This factor Z(m) is then applied to the value of $m^{1/2}$ from equation (48) to determine the accurate mass. The value determined from equation (48) is divided by Z(m).

The values of $t_0$, A, and B are determined by least squares fit from three or more peaks to equation (46). If a systematic variation of Z is observed, then the higher order term may be important, and the offset $m_0$ may be necessary to compensate for the systematic error in the calibration.

Calibration of MS-2

The time of flight through MS-2 is given by $$t=(D_{es}/v)+(D/v)\{1+(4d_3/D)(V_T/V_1)\{1+[(d_4^0/d_3)(V_1/[V_2-V_1])-1][1-(m_p/m_f)(V_1/V_T)]^{1/2}\} \quad (50)$$

where $$V_T=V_T^0[1-(V/V_T^0)(1-m_f/m_p)]$$

And $$V_T^0=V_a+V_{s2}(1-x/d_2)$$

V is the energy of the ions in MS-1, $V_{s2}$ is the amplitude of the voltage pulse in source 2, and $V_a$ is the potential difference across the second accelerating region in source 2. $x=vt_2-d_1$ is the distance that a selected ion enters into source 2 at the time $t_2$ that the accelerating pulse is applied. $V_T$ is the energy of the ions in MS-2, $V_1$ the potential applied to the first region of the two-field mirror, $V_2$ is the potential applied to back of the mirror, $d_3$ is the length of the first region of the mirror, $d_4^0$ the length of the second, and D is the total length of the field-free region between the source focus and the detector. The velocity of the ions in the field-free region, v, is given by $$v=(2zV_T/m)^{1/2}=C(V_T/m)^{1/2} \quad (51)$$

With first and second order focusing of the ion mirror the flight time of ions is independent to first and second order of the energy $V_T$ of the ions. Thus to first order the flight time of ions is given by $$t(m_f/m_p)-t_0(m_p)=[m_f^{1/2}D_e/C(V_T^0)^{1/2}]\{(D_{es}/D_e)\{1-(V/V_T^0)(1-m_f/m_p)\}^{-1/2}]+D_{em}/D_e\} \quad (52)$$

and to first order $$\{1-(V/V_T^0)(1-m_f/m_p)\}^{-1/2}=1+(V/2V_T^0)(1-m_f/m_p) \quad (53)$$

then $$[t(m_f/m_p)-t_0(m_p)]/[t(m_p)-t_0(m_p)]=[(m_f/m_p)^{1/2}\{(D_{es}/D_e)\{1+(V/2V_T^0)(1-m_f/m_p)\}+D_{em}/D_e\}=(m_f/m_p)^{1/2}\{(D_{em}/D_e)+(D_{es}/D_e)\{1+(V/2V_T^0)(1-m_f/m_p)\}\}] \quad (54)$$

define $$A=D_{es}/D_e;\ B=V/2V_T^0;\ K=AB \quad (55)$$

$$X=t(m_f/m_p)-t_0(m_p)/t(m_p)-t_0(m_p)=[(m_f/m_p)^{1/2}(1+K(1-m_f/m_p)] \quad (56)$$

To first order the equation can be inverted to give $$(m_f/m_p)^{1/2}=X[1-K(1-m_f/m_p)] \quad (57)$$

$$q=X[1-K(1-q^2)] \quad (58)$$

$$q^2-q/KX+(1-K)/K=0 \quad (59)$$

$$q=(2KX)^{-1}\{1-[1-4(1-K)KX^2]^{1/2}\}=(m_f/m_p)^{1/2} \quad (60)$$

This is first order approximation. The accuracy can be improved by the following procedure.

$$K=[1-X^{-1}(m_f/m_p)^{1/2}]/(1-m_f/m_p)=K_0(1+\alpha X^n) \quad (61)$$

Determine K for each value of $m_f/m_p$ in the reference spectrum and fit results to determine $K_0$, α, and n. The exponent n is expected to be negative and default value of $K_0$ is given above. The value of K(X) is then used in equation (60) to determine $m_f/m_p$.

Multiplexed MS-MS

The second source pulse duration is just sufficient to allow the ion to exit the source, and the voltage is returned to zero before the next ion is close enough to experience significant deceleration as it approaches. Using the distances given in Table I, this minimum distance is about 10 mm and the effective distance to the second source is 1700.

$$\Delta m/m=2\Delta t/t=2\Delta d/D_{eff}=20/1700=1.2\% \quad (62)$$

Thus the minimum ratio of selectable masses is about 1.012. When selected masses are close, the fragment spectra overlap and must be deconvoluted to determine the fragments due to each precursor. The degree of overlap is determined by the flight time to the second source, $t_1$ relative to the total flight time, $t_1+t_2$, to the detector. The flight times are proportional to the effective distances divided by the square root of the ion energy. The nominal energy in MS-1 is 2 keV, and in MS-2 it is 14 keV. The effective distance in MS-2 is 1262. Thus the ratio of selectable masses with no overlap of fragment spectra is given by $$m_2/m_1=[(t_1+t_2)/t_1)]^2=[1+(1262/7^{1/2})/1700]^2=1.64 \quad (63)$$

This can be improved substantially if only a limited mass range of fragments is of interest. For example, for quantitation using a technique such as ITRAQ measurement of fragment masses in a narrow range is required. These methods are disclosed in U.S. Pat. No. 6,621,074.

The fragment selector after the second source can be used to transmit only this narrow range of fragment ions, and precursor masses differing by only 1.2% can be quantified using multiplex mode. Thus, in the best case up to 135 different precursors between 800 and 4000 da can be selected and quantified in a single multiplexed measurement.

For the geometry discussed above the flight time from the first source to the second is approximately 86,480 $m^{1/2}$ nanoseconds. Thus the minimum time between adjacent selected masses is 1040 $m^{1/2}$. To select a fragment region from a particular precursor with no overlap the timed-ion-selector must be placed no further from the second source than the time it takes for a precursor to reach that point. The time for a precursor to reach a particular effective distance from the source is given by $$t_2(m_p)=d_{2e}/v_2=19.22d_{2e}m^{1/2} \text{ for 14 kV ions.} \quad (64)$$

thus $$d_{2e}=1040/19.22=54 \text{ mm} \quad (65)$$

This is approximately equal to the effective length of the ion accelerator; thus the timed-ion-selector is placed in the drift space immediately adjacent to the entrance. The time that the selector can be open without causing overlap in spectra at the detector is proportional to the effective distance to the gate relative to the effective distance to the detector.

$$\Delta t_{max}=(54/1262)1040m^{1/2}=44.5m^{1/2} \text{ nanosec.} \quad (66)$$

$$\text{And } \Delta m_{max}=[2(44.5)/1040](m_f m_p)^{1/2}=0.085(m_f m_p)^{1/2} \quad (67)$$

Where $m_f$ is the nominal fragment mass in the selected region. Thus the maximum width of the selectable window in the ITRAQ region around m=0.115 kDa ranges from 25 Da at $m_p$=0.8 kDa to 57 Da at 4 kDa. Any other mass range can be selected according to equation (67), for example for precursor scanning or multiple reaction monitoring.

Deconvolution of Multiplexed Fragment Spectra

If fragment selection is not employed, the degree of overlap possible for identification and sequencing of peptides depends on the details of the deconvolution algorithm and the quality of the spectra. The precursor mass of each selected peptide is known to within a few ppm from the MS measurement. One approach to deconvoluting the overlapping spectra is to search all of the spectra simultaneously against the database. This will require relatively accurate masses for the fragments. An advantage of multiplexing is that the fragment mass scale of all of the peptides present can be internally calibrated using the fragments from as single known peptide. Thus, by adding an internal standard or using an identified peptide in the mix, the fragment spectra can be calibrated with an estimated uncertainty of ca. 10 ppm. Higher resolution precursor selection will also improve the reliability of deconvolution by removal of isotope peaks. Searching against a database of measured spectra rather than theoretical spectra with no intensity information should also dramatically improve the speed and reliability of deconvolution. It is expected that multiplexing will be most useful in cases requiring highest throughput, but where most of the expected proteins have been detected and analyzed in previous measurements.

The deconvolution problem does not appear as difficult as might be expected. If we consider a relatively wide window, ca. 0.4 da, that includes essentially all possible exact masses of peptides, then for a peptide with m/z 2000 there are 5000 time bins that could potentially contain fragments. But for a typical fragment spectrum that includes at most 50 peaks with significant intensity, only 50 of these bins are occupied. Thus for any 2 precursors the probability that peaks from each are detected in a single bin is not more than 0.01%. On the other hand, there is about a 40% chance that a peak from one occurs at a possible peptide mass in the region of overlap. Thus, in the worst case the time region corresponding to possible fragments from a given precursor might contain 20 peaks due to overlapping spectra in addition to the 50 correct peaks. This may lead to some false identifications in the first pass, but with 10 ppm accuracy for the fragment masses, most of these can be eliminated in a second pass. With 10 ppm accuracy the probability of incorrect assignment of a peak is reduced to about 1%.

If the masses selected differ by less than a factor of about 1.6, then the fragments from multiple precursors may occur within the same time range in the fragment TOF spectrum.

In the region of overlap the assignment of the peaks to one or other precursor is made on the basis of the following criteria:

1. The apparent mass defect of the fragment ion is within the range expected for fragments of a given precursor.
2. The intensity is within the expected range for a fragment of the given precursor. Intensities (expressed in ions/laser shot) are generally less than ca. 10% of total precursor intensity; thus a large peak is not a fragment of a weak precursor.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for multiplex operation of a tandem time-of-flight mass spectrometer comprising:

(a) selecting a predetermined set of ions with a first timed-ion-selector, said set of ions comprising one or more precursor ions and their associated fragment ions, wherein the masses of any two precursor ions of the predetermined set of ions differ by at least 1 percent in mass;

(b) accelerating said predetermined set of ions and their associated fragment ions using a pulsed ion accelerator;

(c) selecting a portion of the fragment ions associated with the predetermined set of ions with a second timed-ion-selector;

(d) energizing the second timed-ion selector to transmit only a predetermined portion of a fragment ion spectrum to minimize overlap between fragment spectra from different precursor ions;

(e) transmitting the predetermined portion of the fragment ion spectrum to an ion detector; and (f) detecting a fragment ion spectra with the ion detector.

2. The method of claim 1 wherein fragment ions from precursor masses differing by a factor of 1.6 or less in mass are assigned to the correct precursor by consideration of apparent mass defect of the fragment ion.

3. The method of claim 1 wherein fragment ions from precursor masses differing by a factor of 1.6 or less in mass are assigned to the correct precursor by consideration of the intensity of the fragment ion relative to the intensity of the precursor.

4. The method of claim 1 further comprising comparing the fragment ion spectra with a database.

5. The method of claim 1 wherein the selecting the portion of the fragment ions associated with the predetermined set of ions rejects unfragmented ions.

6. The method of claim 1 wherein the selecting the portion of the fragment ions associated with the predetermined set of ions transmits a selected portion of the fragment ions within a desired mass range.

7. The method of claim 1 further comprising deconvoluting the fragment ion spectra to determine the fragments due to each precursor ion.

8. The method of claim 7 wherein the deconvoluting comprises searching all of the spectra simultaneously and comparing the spectra to a database of known spectra.

9. The method of claim 1 further comprising calibrating a fragment mass scale of precursor ions using fragment ions from a single precursor ion.

10. The method of claim 1 further comprising deflecting a remaining portion of the fragment ions associated with the predetermined set of ions away from the ion detector.

11. The method of claim 1 further comprising fragmenting ions in the predetermined set of ions with a laser.

12. The method of claim 1 further comprising fragmenting ions in the predetermined set of ions by passing the predetermined set of ions through a collision cell.

* * * * *